US007066618B1

(12) United States Patent
Little

(10) Patent No.: US 7,066,618 B1
(45) Date of Patent: Jun. 27, 2006

(54) DRIP EDGING AND GUTTER MOUNTINGS DESIGNED FOR DECORATIVE LIGHTS

(76) Inventor: Harold Little, 4875 Tick Ridge Rd., Grand Chain, IL (US) 62941

( * ) Notice: Subject to any disclaimer, the term of this patent is extended or adjusted under 35 U.S.C. 154(b) by 97 days.

(21) Appl. No.: 10/634,094

(22) Filed: Aug. 4, 2003

(51) Int. Cl.
*F21S 4/00* (2006.01)
*F21V 21/088* (2006.01)

(52) U.S. Cl. ..... 362/147; 362/152; 362/249; 248/227.4

(58) Field of Classification Search ..... 362/250–252, 362/396, 145, 147, 151, 152, 249; 52/11–16, 52/94; 248/227.4, 227.1, 226.11
See application file for complete search history.

(56) References Cited

U.S. PATENT DOCUMENTS

| | | | | | |
|---|---|---|---|---|---|
| 3,204,090 | A | | 8/1965 | Kvarda, Jr. | 362/249 |
| 3,438,604 | A | * | 4/1969 | Spicer | 248/74.5 |
| 3,584,795 | A | * | 6/1971 | Baird | 362/396 |
| 3,599,916 | A | * | 8/1971 | Szabo | 248/73 |
| 4,128,863 | A | | 12/1978 | Premetz | 362/249 |
| 4,888,671 | A | * | 12/1989 | Reimer | 362/250 |
| 4,974,128 | A | | 11/1990 | Prickett | 362/145 |
| 5,056,747 | A | * | 10/1991 | Kireta | 248/231.81 |
| 5,067,061 | A | | 11/1991 | Prickett | 362/145 |
| 5,496,005 | A | * | 3/1996 | Dieringer | 248/74.2 |
| 5,510,966 | A | | 4/1996 | Konecny | 362/249 |
| 5,609,415 | A | * | 3/1997 | Protz, Jr. | 362/396 |
| 5,669,709 | A | * | 9/1997 | Adams | 362/396 |
| 5,724,776 | A | * | 3/1998 | Meadows, Jr. | 52/94 |
| 5,816,687 | A | | 10/1998 | Tapp | 362/250 |
| 5,893,628 | A | | 4/1999 | Byers | 362/252 |
| 6,050,709 | A | | 4/2000 | Hastings | 362/375 |
| 6,076,938 | A | * | 6/2000 | Kinderman | 362/249 |
| 6,109,765 | A | | 8/2000 | Blanton | 362/250 |
| 6,182,933 | B1 | | 2/2001 | Rapp | 248/231.81 |
| 6,494,594 | B1 | * | 12/2002 | Schroetter | 362/249 |
| 6,644,836 | B1 | * | 11/2003 | Adams | 362/396 |
| 6,652,112 | B1 | * | 11/2003 | Lucarelli | 362/145 |
| 2002/0000504 | A1 | * | 1/2002 | Bayne | 248/302 |
| 2002/0186562 | A1 | * | 12/2002 | Schroetter | 362/249 |
| 2003/0198054 | A1 | * | 10/2003 | Adams | 362/396 |

FOREIGN PATENT DOCUMENTS

| | | |
|---|---|---|
| CA | 2.091.397 | 1/1996 |

* cited by examiner

*Primary Examiner*—Michael Safavi
*Assistant Examiner*—Gay Ann Spahn
(74) *Attorney, Agent, or Firm*—Michael I Kroll

(57) ABSTRACT

A drip edging or gutter mounting that includes a permanent member mounted to a structure and a dismountable member selectively connected to the permanent member. The dismountable member includes structure for connecting ornamental structures, such as light strings, to the dismountable member. Upon receipt of the ornamental structures by the connecting structure, the dismountable member is selectively connected to the permanent member to thereby decorate the structure. The dismountable member can be removed from the permanent member with the lights attached for storage thereby eliminating the need for mounting and dismounted light strings to a structure.

3 Claims, 22 Drawing Sheets

DRIP EDGING AND GUTTER MOUNTINGS DESIGNED FOR DECORATIVE LIGHTS

BACKGROUND OF THE INVENTION

1. Field of the Invention

The present invention relates generally to roof or drip edgings and mounting for gutters and, more specifically, to a system of mating rods and channels for mounting decorations onto a structure, such as Christmas lights and storing the lights on a dismountable component of said system during non use.

The present invention provides a roof or drip edging that is permanently mounted to the structure having a rod or channel extending therefrom whereby a dismountable mating rod or channel having a plurality of apertures or hook-like elements extending therefrom and affixed thereto can be releasably attached by slidably engaging the channel over the rod or snapping the channel onto the rod or vice versa. The length of the dismountable element can vary and can include means for folding the dismountable element with the attached decoration thereby obviating the need for removing the decorations from the dismountable element prior to storage.

While the display mounting is shown in various configurations, it is comprised of two components a permanent member and a dismountable member with one being a rod and the other being a channel. The permanent member is defined as extruded aluminum or vinyl formed into various configuration having a mounting base of a rod or channel extending from the roof or drip edging that is attached to the structure at any point selectively determined as appropriate by the installer.

The dismountable member is defined as either a rod or channel being the opposing mating member of the rod or channel positioned on the permanent roof or drip edging. It is further defined as having a plurality of attachment elements for supporting the placement thereon of decorative elements. The dismountable member can be of varying lengths that can incorporate a folding means whereby lengths can be folded into more appropriate lengths suitable for storage.

What's so unique about the channel is once the lights are attached to the channel, they will stay attached. They can be easily folded and stored neatly in a box until further use. When it is time to get them out again, you can just slide them on the track. It will be especially good for steep, pitched roofs. It will enable the user to set the ladder at one corner of the house and shoot the lights up the gable end of the roof edging and down the gutters without the wear and tear of moving up and down on the roof. It will just make the job of putting up and taking down lights a lot easier, faster and safer.

2. Description of the Prior Art

There are other mounting system designed for decorations. Typical of these is U.S. Pat. No. 3,204,090 issued to Kvarda Jr. on Aug. 31, 1965.

Another patent was issued to Premetz on Dec. 5, 1978 as U.S. Pat. No. 4,128,863. Yet another U.S. Pat. No. 4,888,671 was issued to Reimer on Dec. 19, 1989 and still yet another was issued on Nov. 27, 1990 to Prickett as U.S. Pat. No. 4,974,128.

Another patent was issued to Prickett on Nov. 19, 1991 as U.S. Pat. No. 5,067,061. Yet another U.S. Pat. No. 5,510,966 was issued to Konecny on Apr. 23, 1996. Another was issued to Tapp on Oct. 6, 1998 as U.S. Pat. No. 5,816,687 and still yet another was issued on Apr. 13, 1999 to Byers as U.S. Pat. No. 5,893,628.

Another patent was issued to Hastings on Apr. 18, 2000 as U.S. Pat. No. 6,050,709. Yet another U.S. Pat. No. 6,109,765 was issued to Blanton on Aug. 29, 2000. Another was issued to Rapp on Feb. 6, 2001 as U.S. Pat. No. 6,182,933 and still yet another was issued on Oct. 16, 1993 to Kelley et al. as Canadian Patent No. 2,091,397.

U.S. Pat. No. 3,204,090

Inventor: Charles Kvarda, Jr.

Issued: Aug. 31, 1965

An apparatus for holding a string of decorative lights spaced apart in a line and connected by a wiring circuit comprising an elongated thin-wall channel, said channel having a web and a pair of legs, a bent portion formed on the end of said legs throughout their length and parallel to the web, said bent portions confronting each other respectively to provide hooks for use in supporting said apparatus, said web being perforated to provide spaced openings throughout its length intermediate said legs, said perforations receiving electrical lamps secured in sockets, one of said legs being perforated proximate to each end respectively, fittings in engagement with said perforations in the leg, and hooks in engagement with the fittings, said hooks supporting the apparatus, said lamps being exterior of said channel and said wiring and sockets being retained in said channel means on the opposite side of said web from said lamps.

U.S. Pat. No. 4,128,863

Inventor: Micael J. Premetz

Issued: Dec. 5, 1978

A string of outdoor decorative lights is connected to a facer board on a building cave. A stowable embodiment of the invention provides hinged attachment to the facer board and means for securing the string in a display position or in a hidden position. Snap-in tabs hold the string in either position.

U.S. Pat. No. 4,888,671

Inventor: Peter Reimer

Issued: Dec. 19, 1989

Ornamental light mounting strip 10 having an elongated resilient base 11 and removably attached light socket holders 13. Light socket holders 13 have a first receiving channel 14 for receiving a typical light bulb and socket 17 and a second receiving channel 18 for receiving rib 12 attached to the elongated resilient base 11. The previously described second receiving channel 18 and rib 12 provide for adjustable attachment of the light socket holder 13 to the elongated base 11.

U.S. Pat. No. 4,974,128

Inventor: Nov. 27, 1990

Issued: Nov. 27, 1990

A decorative trim lighting system comprises an elongated, extruded plastic retaining strip which is formed in a laterally folded configuration and is adhesively securable along an exterior edge portion of a building. A series of support tab members are insertable between the folded side portions of the retaining strip, at longitudinally spaced intervals along the strip, and are frictionally gripped and retained by the facing side portions of the strip. The tabs have outer end portions which support the light elements of a decorative light string along the building portion edge. The retaining strip may be left in place on the building when the light string and associated support tabs are removed, and permits rapid and easy reinstallation of the light string. Additionally, the spacing between the individual light elements may be easily adjusted simply by sliding their support tabs along the length of the retaining strip.

U.S. Pat. No. 5,067,061

Inventor: Robert B. Prickett

Issued: Nov. 19, 1991

A decorative trim lighting system includes an elongated, resilient retaining strip which is formed in a laterally folded configuration and is securable to an exterior surface portion of a building. The bulb socket portions of a decorative light string are removably received in a longitudinally spaced series of openings formed through the strip, and a longitudinally spaced series of bent edge portions of the strip overlie and releasably hold the longitudinal electrical power supply wiring segments interconnecting the sockets. The strip may also be used to slidably and releasably hold enlarged end portions of retaining tab members to which the sockets are secured.

U.S. Pat. No. 5,510,966

Inventor: Frances C. Konecny

Issued: Apr. 23, 1996

A fixture is provided for mounting to a structure, and which protectively encloses one or more strings of decorative lights when the lights are not in use. The fixture is constructed of an elongated, closed housing open on one side, with a closure moveable to protectively enclose the lights within the fixture or to expose the lights for viewing.

U.S. Pat. No. 5,816,687

Inventor: F. Barry Tapp

Issued: Oct. 6, 1998

An apparatus for attaching a string of lights to a surface so the lights may selectively concealed or revealed. The apparatus includes a base for attachment to the surface and a removable cover or a hingable cap for selectively exposing the lights.

U.S. Pat. No. 5,893,628

Inventor: Thomas L. Byers

Issued: Apr. 13, 1999

Improvements in components for mounting decorative light strings to various mounting sites include a plurality of track channels for holding light strings. Track channels may be attached to the mounting site with various fasteners or with snap buttons. The track channels may include an upper panel, legs extending downward from the upper panel and base panels parallel to the upper panel. The base panels may define a snap channel therebetween. The snap buttons may be received in the snap channels defined by the base panels to secure the track channel to the mounting site.

U.S. Pat. No. 6,050,709

Inventor: Herman Hastings

Issued: Apr. 18, 2000

A light string mounting system for retaining and protecting at least one light string during nonuse. The inventive device includes an elongated base having a U-shaped cross-section, a cover pivotally attached to an upper portion of the base, a bias spring between the cover and the base, and a pair of tracks within the base which receive a plurality of clips. The bias spring retains the cover in the closed position when the light string is not in use. When the cover is opened to expose the light string, the bias spring retains the cover in the open position. The cover and the base are coated with material which matches the color of the trim of the building structure.

U.S. Pat. No. 6,109,765

Inventor: Fred T. Blanton

Issued: Aug. 29, 2000

A variable-position decorative light mounting system for mounting the bulb and socket assemblies of a string of decorative lights at selective positions to achieve decorative effects. A base member provided in elongate strips or shorter rectangular sizes is configured to be secured to a supporting surface and has a flat surface with an outwardly projecting protuberance extending longitudinally along the flat surface with a contiguous reduced neck portion at the juncture of the protuberance with the flat surface. One or more bulb-holding clip members having a bottom portion with a cross sectional shape closely corresponding to the cross sectional shape of the protuberance are removably received and engaged on the protuberance by snap attachment. The bulb-holding clips have a contiguous upper portion with an aperture configured to removably receive and substantially encircle a portion of the bulb and socket assembly to releasably retain it on the clip. One or more wire-holding clip members may also be removably received and engaged on the rotuberance by snap attachment to capture a portion of the electrical supply cord between the protuberance and an underside of the clip at selective longitudinally spaced locations such that remaining portions of the electrical supply cord along with a plurality of the decorative bulb and socket assemblies are suspended from the retained portions of the electrical supply cord to achieve decorative ornamental effects.

U.S. Pat. No. 6,182,933

Inventor: Daniel T. Rapp

Issued: Feb. 6, 2001

The friction-mountable plastic hanger has an extrusion profile that defines a stiff depending hook for hanging an object and a cantilevered mounting structure extending from the hook. The cantilevered structure may consist of a single mounting arm with resiliently deformable transversely extending fins angularly projecting from the opposite faces of the arm in a direction backward toward the hook, or a stiff U-shaped mounting structure having a pair of parallel cantilevered mounting arms with interior facing surfaces equipped with resiliently deformable transversely extending fins that angularly project from the interior surfaces of the arms in a direction backward toward the hook. All parts of both have a uniform width dimension that extends perpendicular to the extrusion profile. The fins on the mounting arms are resiliently deformed by bending into a frictionally engaging relationship against structural surfaces when the hangers are frictionally mounted.

Canadian Patent No. CA 2,091,397

Inventor: Tommy Dale Kelley, et al.

Issued: Oct. 16, 1993

An assembly is provided for sealingly anchoring a sheet-like base roofing material on a building structure. The assembly includes an anchoring flange or plate having a number of openings therethrough, and a marginal strip of sheet material overlies the anchoring flange and is bonded directly to the base roofing material through the openings, and preferably at a location interior of the anchoring flange. The assembly can be used in roof edge installations, for example, and can also include a fascia or gutter arrangement, or a wide variety of other configurations to suit a given application.

While these mounting systems may be suitable for the purposes for which they were designed, they would not be as suitable for the purposes of the present invention, as hereinafter described.

SUMMARY OF THE PRESENT INVENTION

A primary object of the present invention is to provide a display mounting comprised of a permanent member and a dismountable member.

Another object of the present invention is to provide a display mounting wherein said permanent member has means for mounting said member to a structure and a rail or channel extending therefrom.

Yet another object of the present invention is to provide a display mounting wherein said means for mounting includes a length of extruded aluminum or vinyl forming a mounting means for fastening the display mounting to a gutter.

Still yet another object of the present invention is to provide a display mounting wherein said means for mounting includes a length of extruded aluminum or vinyl forming a mounting means for mounting to the fascia board of a structure while the opposing side terminates in the form of the track or channel.

Another object of the present invention is to provide a display mounting wherein said means for mounting includes a length of extruded aluminum or vinyl having a topmost flange extending therefrom providing means for fastening the said mounting to the roof of said structure. One of the spaced apart walls engages the fascia board while the opposing side terminates in the form of the track or channel.

Yet another object of the present invention is to provide a display mounting wherein said means for mounting includes a length of extruded aluminum or vinyl wherein said topmost side provides means for fastening the display to the roof of said structure and said adjacent side terminates in the form of the track or channel.

Still yet another object of the present invention is to provide a display mounting having a mountable track or channel that slides onto the mating track or channel of the permanent member.

Another object of the present invention is to provide a display mounting having a mountable track or channel that snaps onto the mating track or channel of the permanent member.

Yet another object of the present invention is to provide a display mounting having a mountable track or channel having a plurality of fasteners extending therefrom.

Still yet another object of the present invention is to provide a display mounting having a mountable track or channel having a plurality of hinges whereby said track or channel can be folded.

Additional objects of the present invention will appear as the description proceeds.

The present invention overcomes the shortcomings of the prior art by providing a display mountings comprised of mating rails and channels for mounting decorations, such as Christmas lights onto a structure and storing the lights on a component of said system during non use. The present invention provides a roof or drip edging that is permanently mounted to the structure having a rail or channel extending therefrom whereby a mating rail or channel having a plurality of apertures or hook-like elements affixed thereto can be releasably attached by slidably engaging the channel onto the track or snapping the channel over the track or vice versa. The length of the dismountable element can vary and can include means for folding thereby obviating the need for removing the decorations from the storable element The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
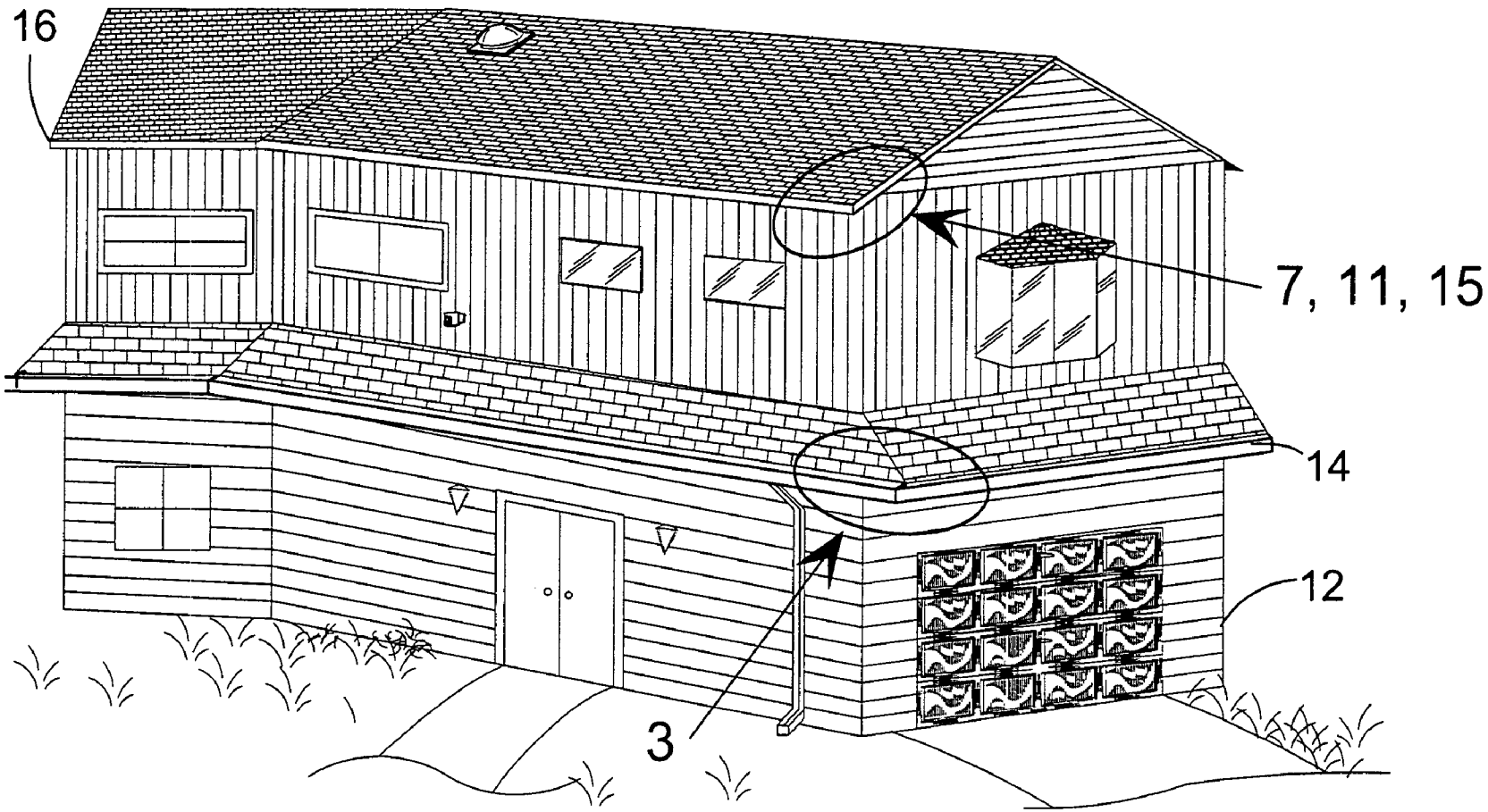
FIG. 1 is a perspective view of the present invention in use.

Turning now descriptively to the drawings, in which similar reference characters denote similar elements throughout the several views, the Figures illustrate the drip edging and gutter mountings of the present invention. With regard to the reference numerals used, the following numbering is used through out the various drawing Figures.

10 drip edging and gutter mountings for decorative lights
12 structure
14 gutter
16 roof edge
17 drip edging
18 permanent member
19 gutter mounting
20 unshaped connector
22 flange
23 permanent member channel
24 rod
25 permanent member aperture
26 dismountable member
27 dismountable member rod
28 channel
32 hooks
34 ornamental structures
36 aperture
38 fastener
40 gutter support
41 recess
42 T-shaped connector
44 extender
46 L-shaped connector
48 underside connector
50 connection track
52 slot
54 horizontal block connector
56 horizontal block track
57 aperture
58 horizontal block
60 vertical block connector
62 vertical block track
63 aperture
64 vertical block
66 vertical block extender
68 socket clips

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is a perspective view of the present invention in use. Described is a means for mounting decorative lights to a structure comprised of two components, a permanent member and a dismountable member. The permanent member can be either a gutter mounting or roof or drip edging mounting. The engaging elements between the permanent member and dismountable member are a channel element and channel-engaging element. The permanent member has a channel or channel-engaging element forming an integral part of the permanent member and provides means for mounting the dismountable member thereto. The permanent member which is either a gutter mounting or roof or drip edging mounting is fastened to the gutter or roof edge of the structure permanently by fasteners at any point selectively determined as appropriate by the installer. The dismountable member is defined as either the channel or channel-engaging element that mates with the opposing channel or channel-engaging element of the permanent member. It is further defined as incorporating means for attaching decorative lights. As illustrated, FIG. 1 is a perspective view of a structure 12 on which the drip edging and gutter mountings 10 of the present invention is selectively mounted. As shown in FIG. 1, the structure 12 is a house. However, the structure 12 can be any building, either residential or commercial, whereby the owner of the structure 12 needs to mount ornamental structures thereon. The structure 12, as illustrated, includes a gutter 14 that lines the perimeter of a first level of the structure. A second level of the structure includes a roof edge 16. The drip edging and gutter mountings 10 of the present invention can be selectively mounted to the structure 12 by affixing the apparatus 10 to at least one of the gutter 14 and/or the roof edge 16. The drip edgings and gutter mountings 10 of the present invention will be discussed and shown hereinafter with specific reference to FIGS. 2–22.

Figure 2:
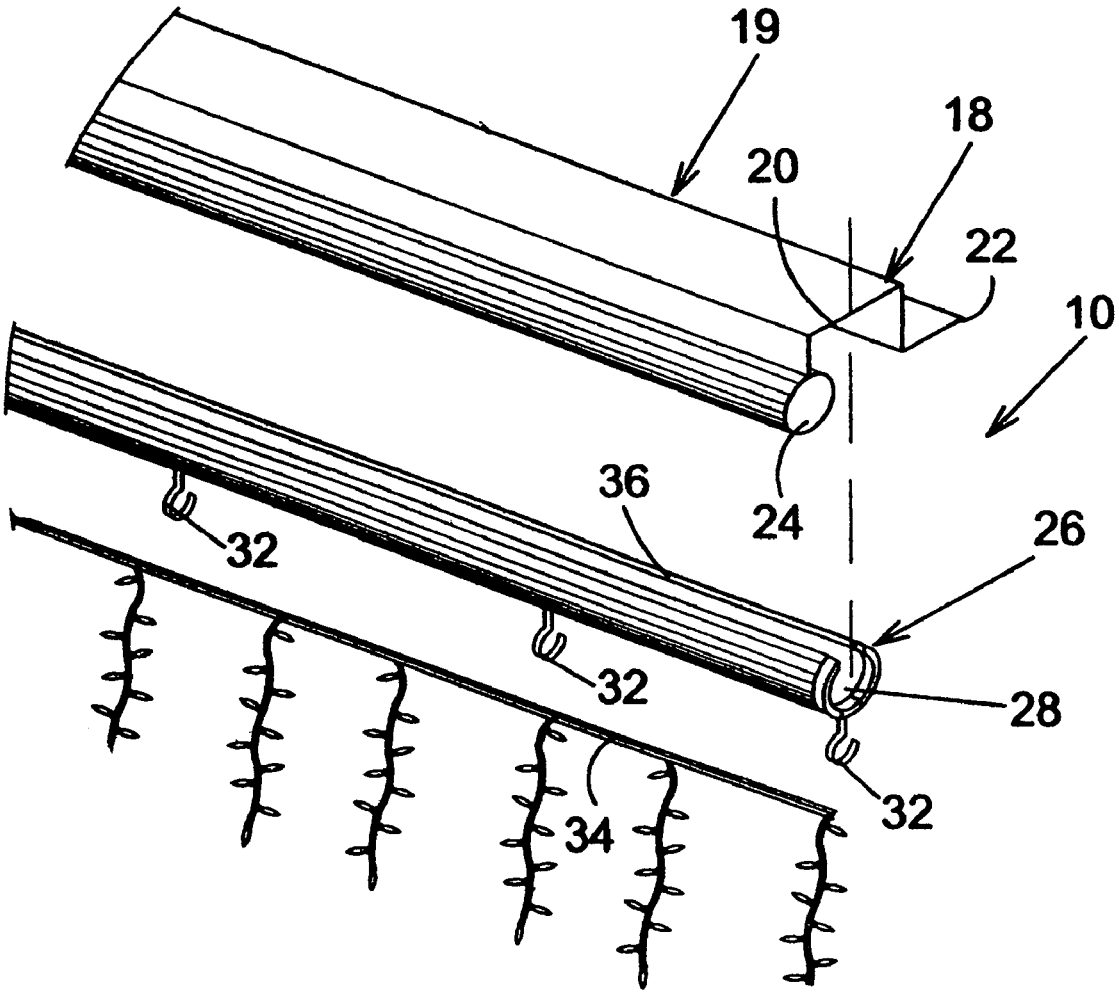
FIG. 2 is a perspective view of the gutter mounting of the present invention.

FIG. 2 is a perspective view of the gutter mounting of the present invention. Shown is the gutter mounting (19) having a channel-engaging element (24) spaced away from the mounting means (19) which is comprised of a flange (22) and u-shaped connector (20) that is mounted to a gutter support element by a fastening means. Once mounted the gutter mounting (19) forms a permanent attachment serving as host to the dismountable member (26) which, in this case would comprise a channel element (28) because the gutter mounting (19) incorporates a channel-engaging element (24). The present invention provides for mating channel and channel-engaging elements. Regardless of which one forms a part of the permanent member (18) the opposing element would form a part of the dismountable member (26). The dismountable member (26) may in some cases slide or snap onto the permanent member (18). The dismountable member (26) can be of varying lengths and can incorporate elements that would allow for the folding of the dismountable member (26) into predetermined lengths suitable for storage with or without the decorative lights attached thereto.

Figure 3:
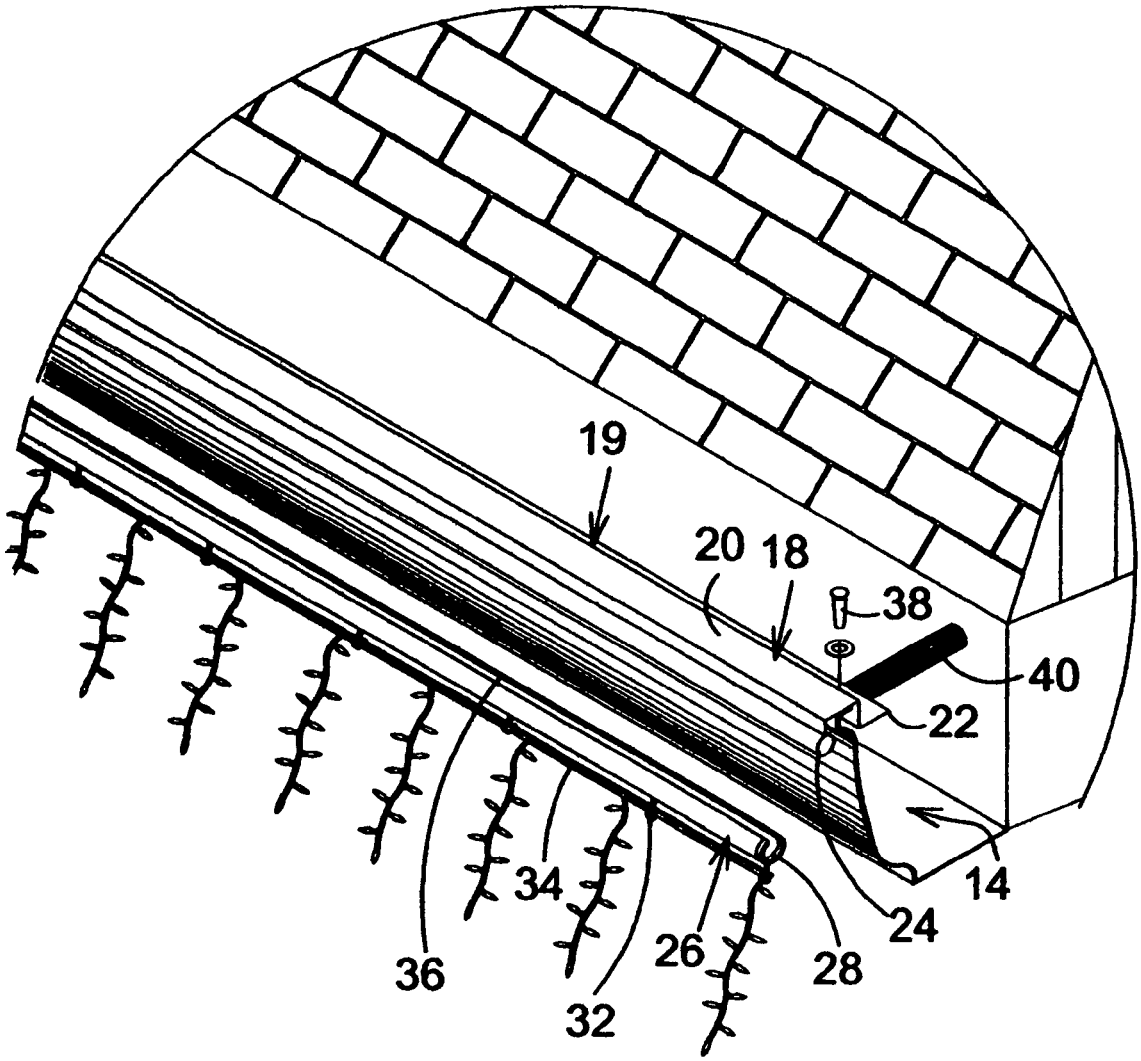
FIG. 3 is a perspective view of the gutter mountings of the present invention.

FIG. 3 is a perspective view of the gutter mountings of the present invention. Shown is the gutter mounting (19) comprising a permanent member (18) fastened to a gutter support (40) using fasteners (38) and the dismountable member (26) having decorative lights (34), such as icicle lights attached thereto by means of hooks (32). In this view, the dismountable member (26) has the channel element (28) and the permanent member (18) has a rod (24) forming the channel-engaging element. The dismountable member (26) can slide or snap onto the rod of the permanent member (18). The dismountable member (26) can also be of varying lengths and incorporate elements that would allow for the folding of the dismountable member (26) into predetermined lengths suitable for storage with or without the decorative lights attached thereto. The present invention provides for mating channel and channel-engaging elements regardless of which one forms a part of the permanent member (18), the opposing element would form a part of the dismountable member (26). The rod (24) is spaced away (20) from the fastening elements (22, 38) to allow clearance for various types of attachable detachable decorations (34).

Figure 4:
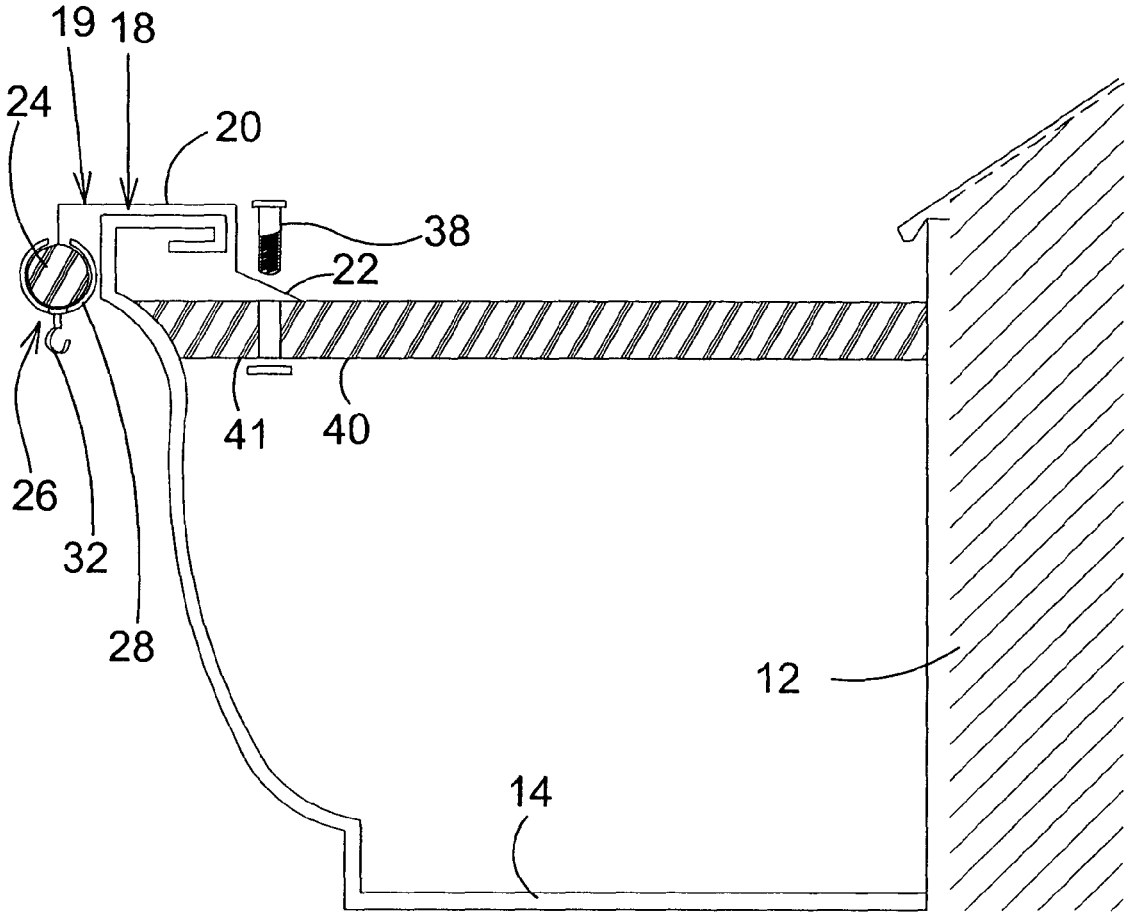
FIG. 4 is a sectional view of the gutter mounting fastened to a gutter.

FIG. 4 is a sectional view of the gutter mounting fastened to a gutter. Shown is the gutter mounting (19) fastened to a gutter support (40) using fasteners (38, 41). The gutter mounting (19) provides a simple method for displaying seasonal decorations without the fuse of having to attach fastening elements such as clips to a gutter year after year. The gutter mounting provides an easy method for attaching a plurality of hangers to a structure such as a gutter (14) by permanently mounting the gutter mounting (19) permanent member (18) and thereafter simply installing and deinstalling the dismountable member (26). The dismountable member (26) can be easily fastened by sliding or snapping it onto the rod (24) of the permanent member (18). The dismountable member (26) can also be of varying lengths to accommodate storage limitations and can incorporate elements that would allow for the folding of the dismountable member (26) into predetermined compact lengths suitable for storage. Incorporating the folding element of the present invention with the dismountable member (26) would provide compact storage of decorative lights. Thus, eliminating the time consuming task of untangling lights and wires by leaving the decorations mounted to the dismountable member (26) during storage.

Figure 5:
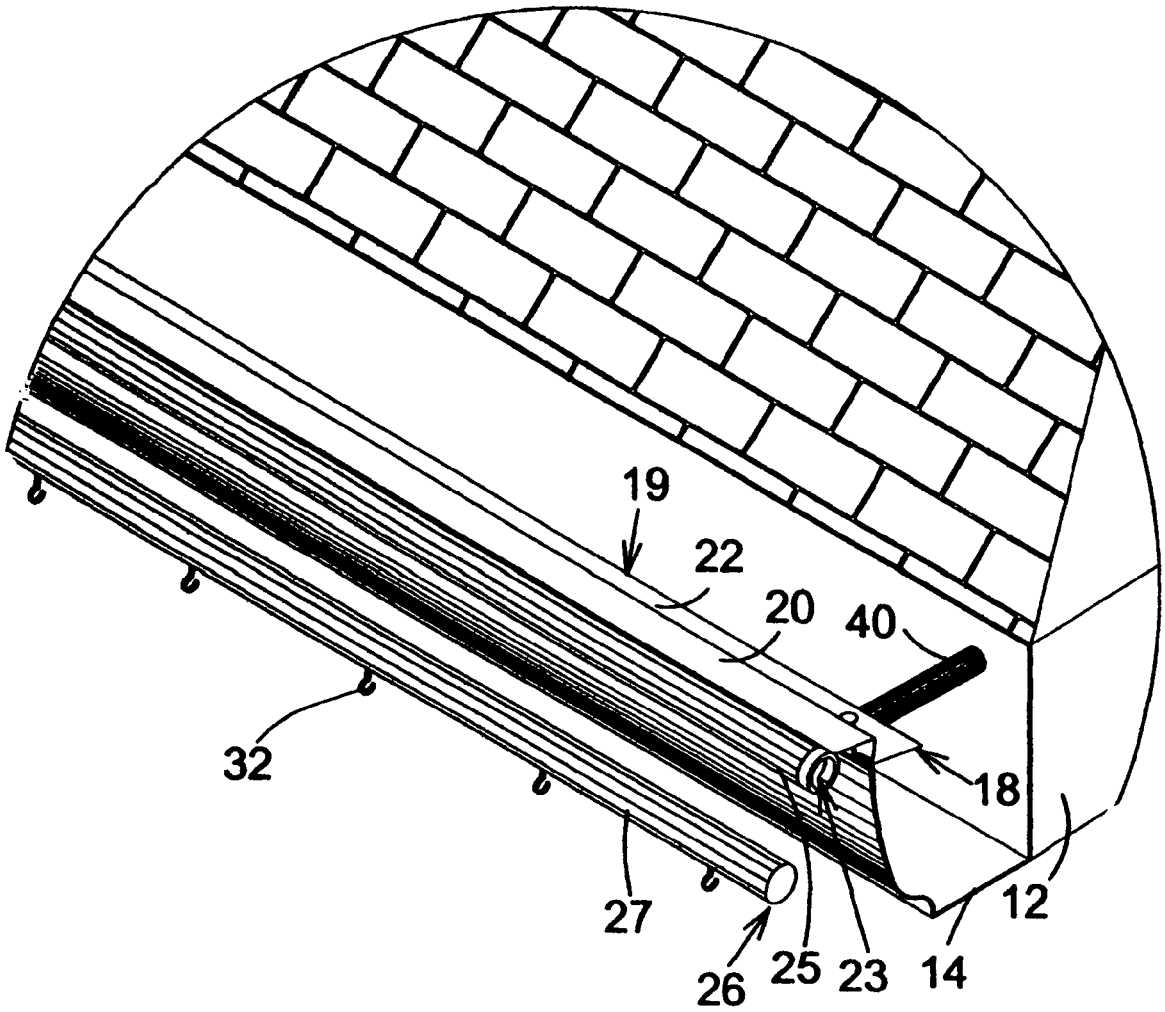
FIG. 5 is a perspective view of the gutter mounting of the present invention.

FIG. 5 is a perspective view of the gutter mounting of the present invention. Shown is the gutter mounting having a gutter mounting (19) permanent member (18) incorporating a channel (23) spaced away from the mounting means which is comprised of a planar flange (22) and u-shaped connector (20) whereby selective mounting can occur at any point deemed suitable by the user. The permanent member (18) serves as base for the dismountable member (26) that is shown as a rod (27) while the permanent member (18) incorporates a channel (23). The present invention provides for mating channel and channel-engaging elements regardless of their location. The dismountable rod member (27) can slide into the permanent channel member (23). The dismountable member (26) can be of varying lengths and can incorporate elements that would allow for the folding of the dismountable member (26) into predetermined lengths suitable for storage with or without the decorations attached thereto.

Figure 6:
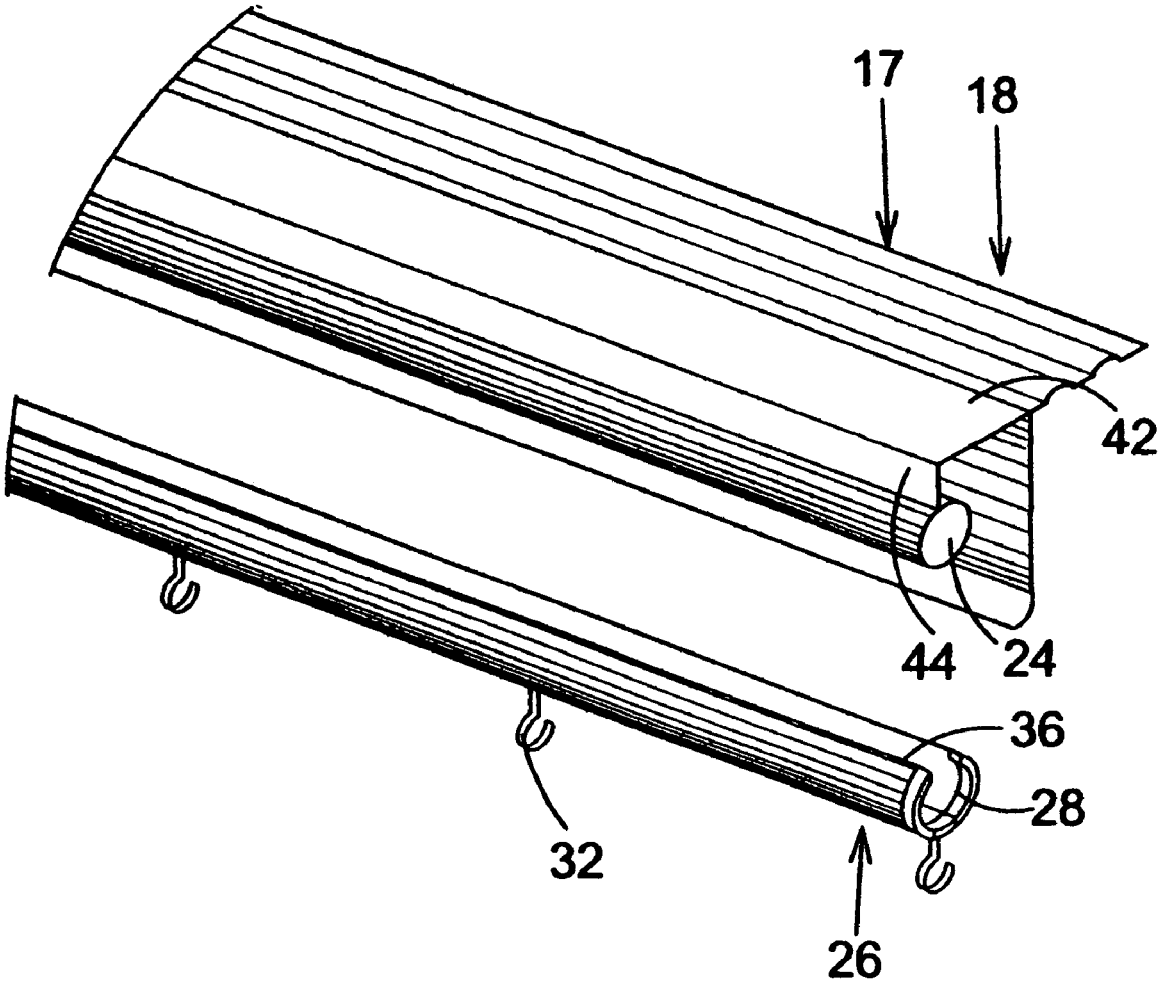
FIG. 6 is a perspective view of the roof or drip edge mounting of the present invention.

FIG. 6 is a perspective view of the roof or drip edge mounting of the present invention. Shown is a roof and drip edging (17) forming the permanent member (18) having a rod (24) as the channel-engaging element spaced away from the mounting means (42) which is a drip edging (17). The drip edging (19) is insertable under the roof shingles and fixedly positioned as the permanent member (18) to the structure. Once mounted the roof and drip edging (17) forms a permanent attachment (18) serving as host to the dismountable member (26) which, in this case would comprise a plastic channel element (26) because the permanent member (18) incorporates a rod (24) as the channel-engaging element. The present invention provides for mating channel elements and channel-engaging elements where one forms a part of the permanent member (18) and the other element forms a part of the dismountable member (26). The dismountable member (26) can slide or snap onto the permanent member (18). The dismountable member (26) can also be of varying lengths and incorporate elements that would allow for the folding of the dismountable member (26) into predetermined lengths suitable for storage with or without the decorations attached thereto.

Figure 7:
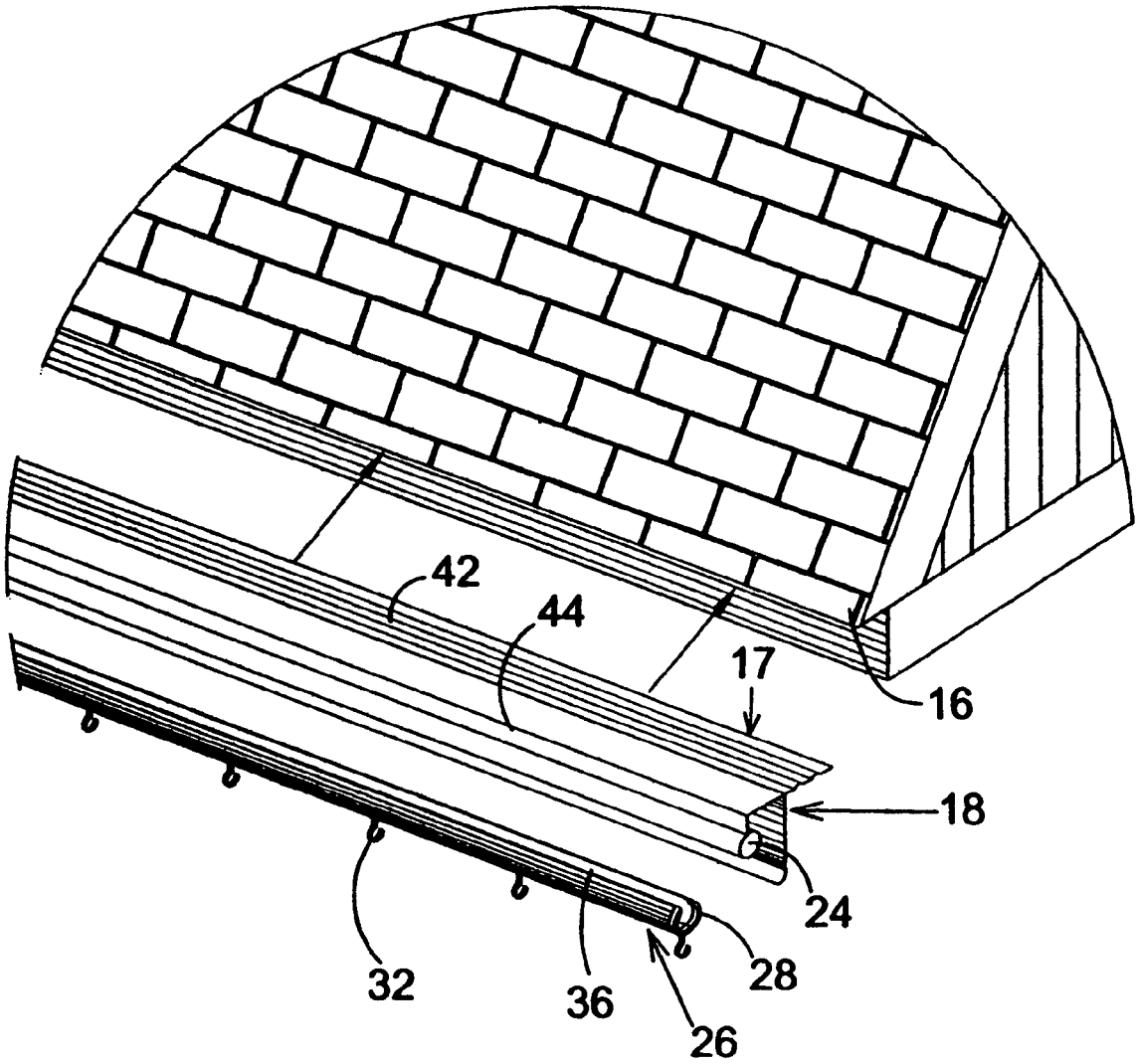
FIG. 7 is a perspective view of the roof or drip edge mounting of the present invention.

FIG. 7 is a perspective view of the roof or drip edge mounting of the present invention. Shown is the roof or drip edging mounting (17) comprising a permanent member (18) having a rod (24) spaced away (44) from its structural mounting portion (42) whereby fasteners will permanently fix its position to the structure (12). The dismountable member (26) is shown ready to be installed. The dismountable member (26) can be or varying lengths that can slide or snap onto the rod of the permanent member (18) and can incorporate elements that would allow for the folding of the dismountable member (26) into predetermined lengths suitable for storage with or without the decorative lights attached thereto. The present invention provides for mating channel and channel-engaging elements wherein one forms a part of the permanent member (18) and the other a part of the dismountable member (26). Regardless of which one forms a part of the permanent member (18), the opposing element would form a part of the dismountable member (26). The rod (24) is spaced away (44) from the fastening elements (42) to allow clearance for various types of attachable detachable decorations.

Figure 8:
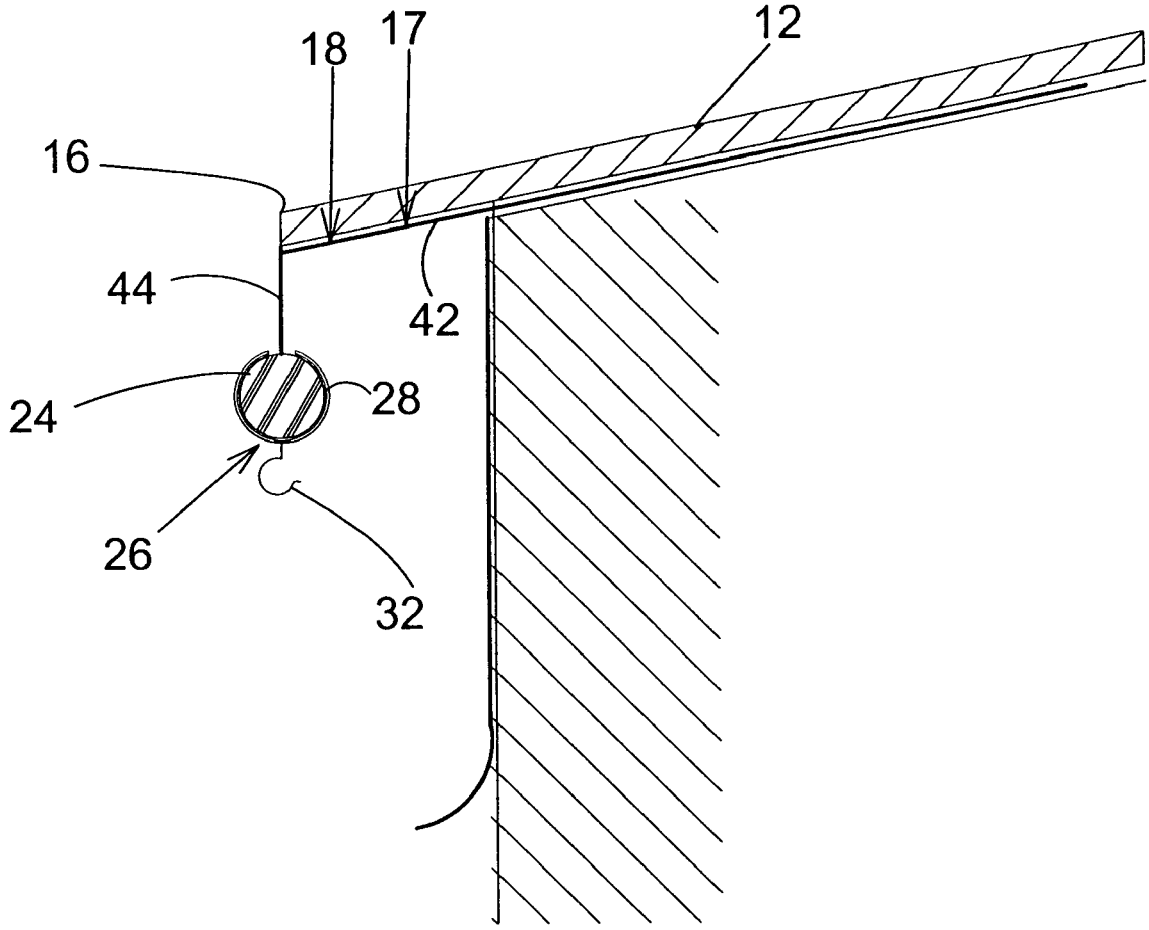
FIG. 8 is a sectional view of the roof or drip edging fastened to a structure.

FIG. 8 is a sectional view of the roof or drip edging fastened to a structure. Shown is the roof or drip edging (17) comprising the permanent member (18) mounted to a structure (12) using fasteners that will permanently fix its position with the dismountable member (26) attached thereto. The dismountable member (26) can slide or snap onto the rod (24) of the permanent member (18). The roof or drip edging (19) provides a simple method for displaying seasonal decorations without the fuse of having to attach fastening element such as clips to a structure year after year. The roof or drip edging (17) provides an easy method for attaching a plurality of hangers (32) to a structure by permanently mounting the roof or drip edging (17) and thereafter simply installing and deinstalling the dismountable member (26). The dismountable member (26) can be easily fastened by sliding or snapping it onto the rod (24) of the permanent member (18). The dismountable member (26) can also be of varying lengths to accommodate storage limitations and can incorporate elements that would allow for the folding of the dismountable member (26) into predetermined compact lengths suitable for storage. Incorporating the folding element of the present invention with the dismountable member (26) would alleviate the time consuming task of untangling lights and wires and similar decorations by leaving the decorations mounted to the dismountable member (26) during storage.

Figure 9:
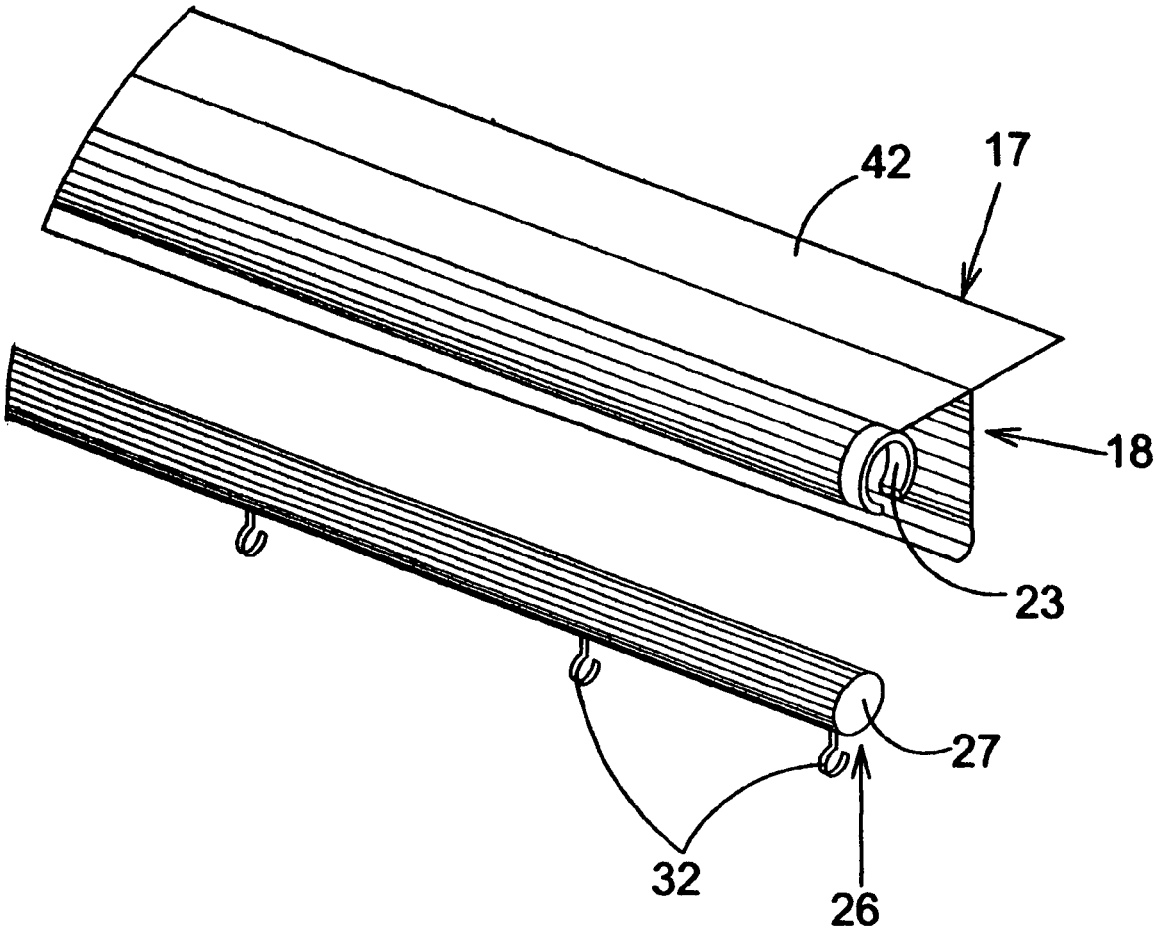
FIG. 9 is a perspective view of the roof or drip edge mounting of the present invention

FIG. 9 is a perspective view of the roof or drip edge mounting of the present invention. Shown is the roof or drip edging (19) forming the permanent member (18) incorporating a mounting means of a channel element (23). The drip edge (17) is insertable under the roof shingles with fasteners used to fixedly position the permanent member (18) to the structure at any point deemed suitable by the user. The permanent member (18) serves as the base for the dismountable member (26) that is shown as a rod (27) while the permanent member (18) incorporates a channel (23). The present invention provides for mating a channel and channel-engaging element wherein one forms a part of the permanent member (18) while the other forms a part of the dismountable member (26). The dismountable rod element can slide into the permanent channel member and can be of varying lengths and can incorporate elements that would allow for the folding of the dismountable member (26) into predetermined lengths suitable for storage with or without the decorative lights attached thereto.

Figure 10:
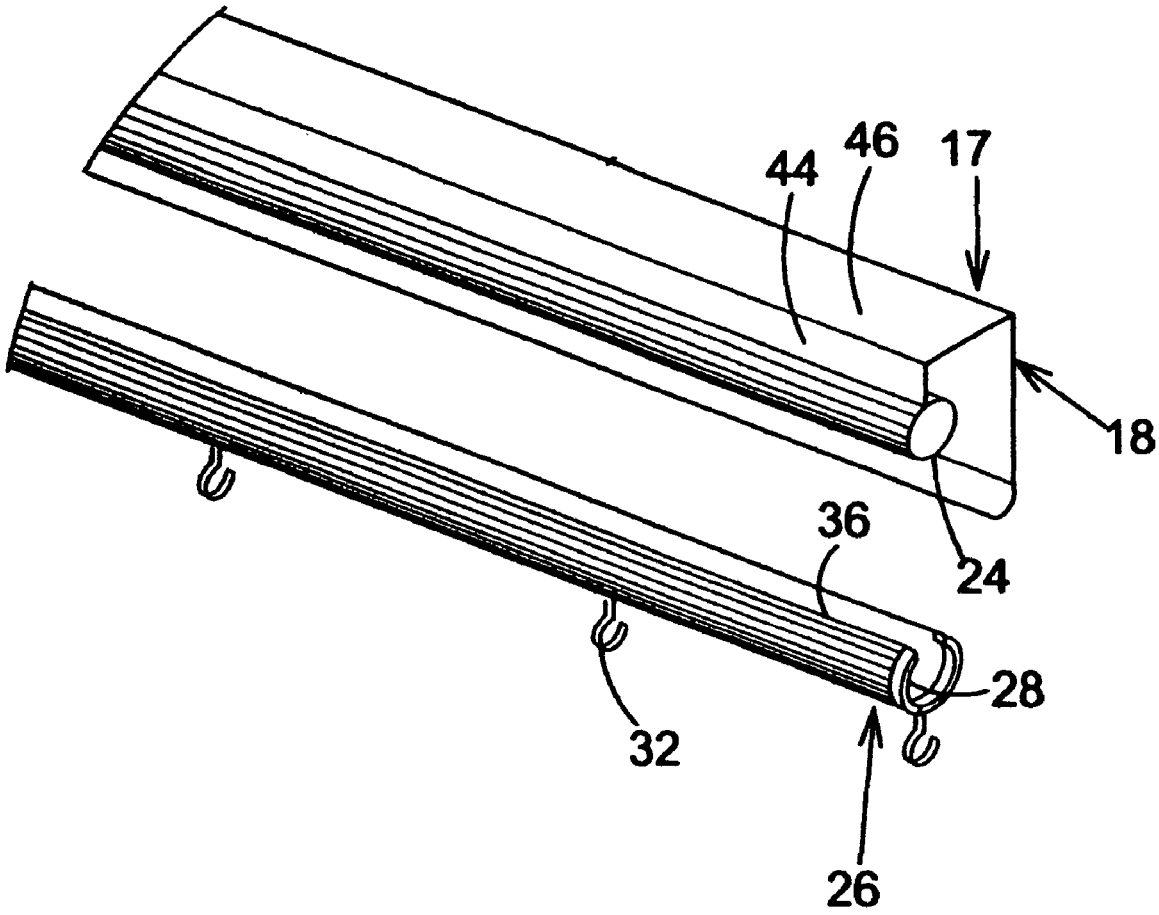
FIG. 10 is a perspective view of the roof or drip edge mounting of the present invention.

FIG. 10 is a perspective view of the roof or drip edge mounting of the present invention. Shown is the roof or drip edge (17) having a rod (24) spaced away (44) from the mounting means which is used to fixedly position the permanent member (18) to the structure (12). Once mounted the roof or drip edging (17) forms the permanent (18) attachment serving as host to the dismountable member (26) which, in this case would comprise a channel (28) element because the permanent member (18) incorporates a rod (24) as the channel-engaging element. The present invention provides for mating channel and channel-engaging elements of the permanent member (18) and dismountable member (26). Wherein one has the channel while the other has the channel-engaging element. The dismountable member (26) can slide or snap onto the permanent member (18). The dismountable member (26) can also be of varying lengths and incorporate elements that would allow for the folding of the dismountable member (26) into predetermined lengths suitable for storage with or without the decorations attached thereto.

Figure 11:
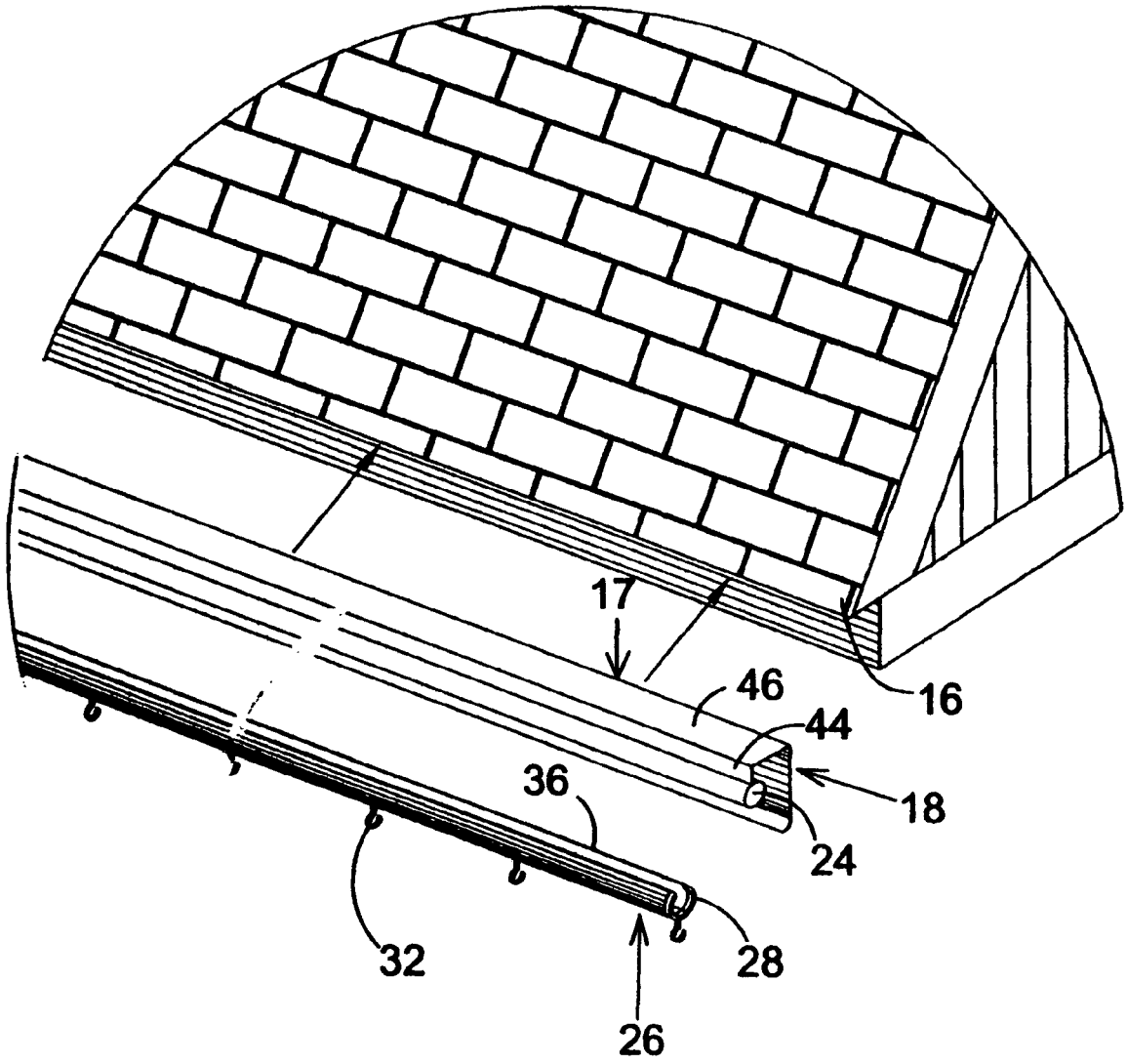
FIG. 11 is a perspective view of the roof or drip edge mounting of the present invention.

FIG. 11 is a perspective view of the roof or drip edge mounting of the present invention. Shown is the roof or drip edging (17) that fits under an existing roof (16) or drip edging and is permanently fixed thereto with the dismountable member (26) ready to be installed. The dismountable member (26) can slide or snap onto the rod (24) of the permanent member (18). The dismountable member (26) can be of varying lengths and can incorporate elements that would allow for the folding of the dismountable member (26) into predetermined lengths suitable for storage with or without the decorations attached thereto. The present invention provides for mating channel and channel-engaging elements wherein the permanent members (18) has one or the other while the dismountable member (26) has the mating element. As shown in this illustration the permanent member (18) has a rod (24) forming the channel-engaging element while the dismountable member (26) has the channel element (28).

Figure 12:
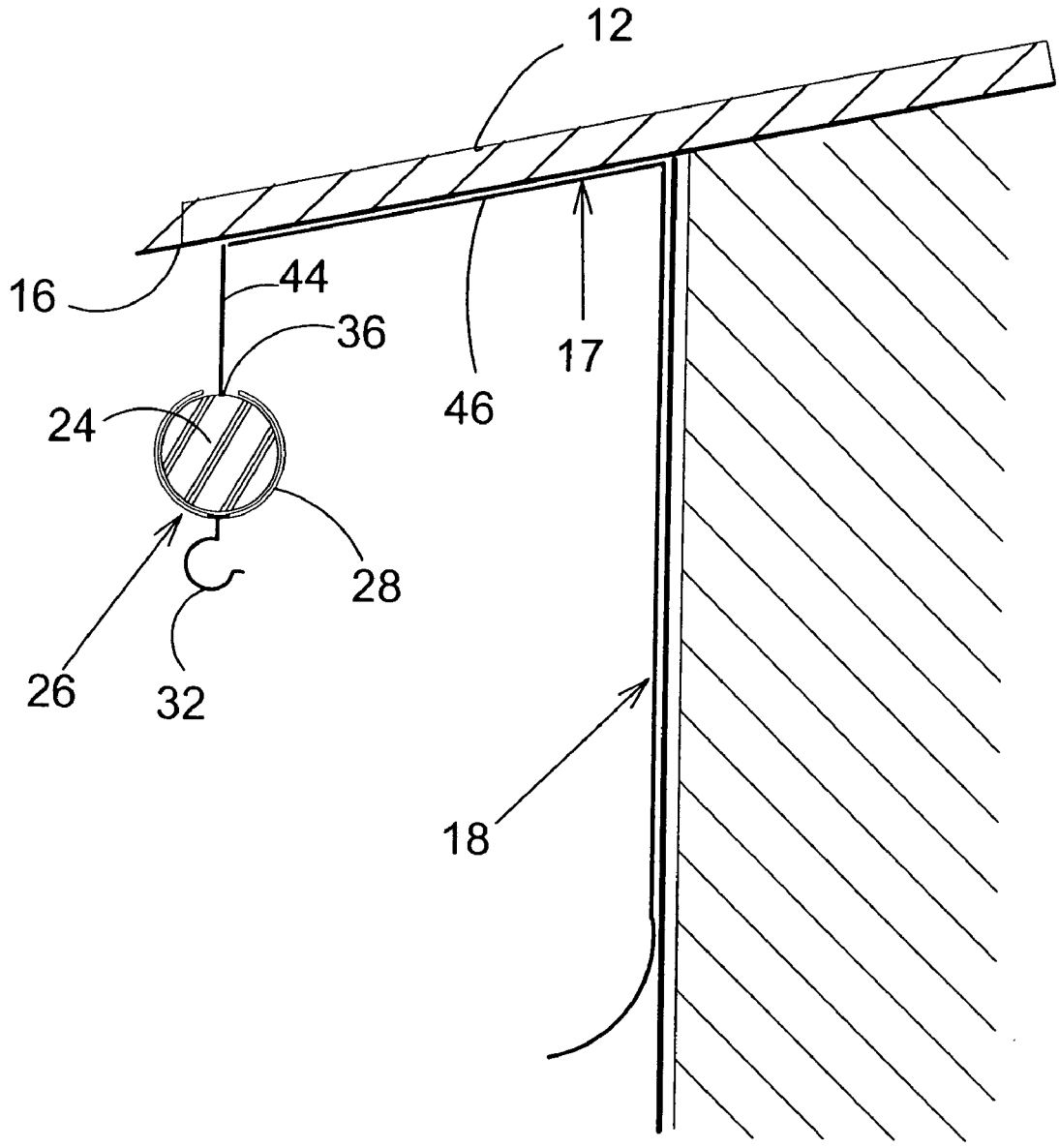
FIG. 12 is a sectional view of the roof or drip edge mounting fastened to a structure.

FIG. 12 is a sectional view of the roof or drip edge mounting fastened to a structure. Shown is the roof or drip edging (17) fastened over an existing roof or drip edging. The present inventions roof or drip edging (17) is mounted to the structure using fasteners that will permanently fix its position with the dismountable member (26) attached thereto. The dismountable member (26) can slide or snap onto the rod (24) of the permanent member (18). The roof or drip edging (17) provides a simple method for displaying seasonal decorations without the fuse of having to attach fastening element such as clips to a structure year after year. The roof or drip edging (17) provides an easy method for attaching a plurality of hangers (32) to a structure by permanently mounting the roof or drip edging (17) and thereafter simply installing and deinstalling the dismountable member (26). The dismountable member (26) can be easily fastened by sliding or snapping (28) it onto the rod (24) of the permanent member (18). The dismountable member (26) can also be of varying lengths to accommodate storage limitations and can incorporate elements that would allow for the folding of the dismountable member (26) into predetermined compact lengths suitable for storage. When incorporating the folding element of the present invention the dismountable member (26) would alleviate the time consuming task of untangling lights and wires and similar decorations by leaving the decorations mounted to the dismountable member (26) during storage.

Figure 13:
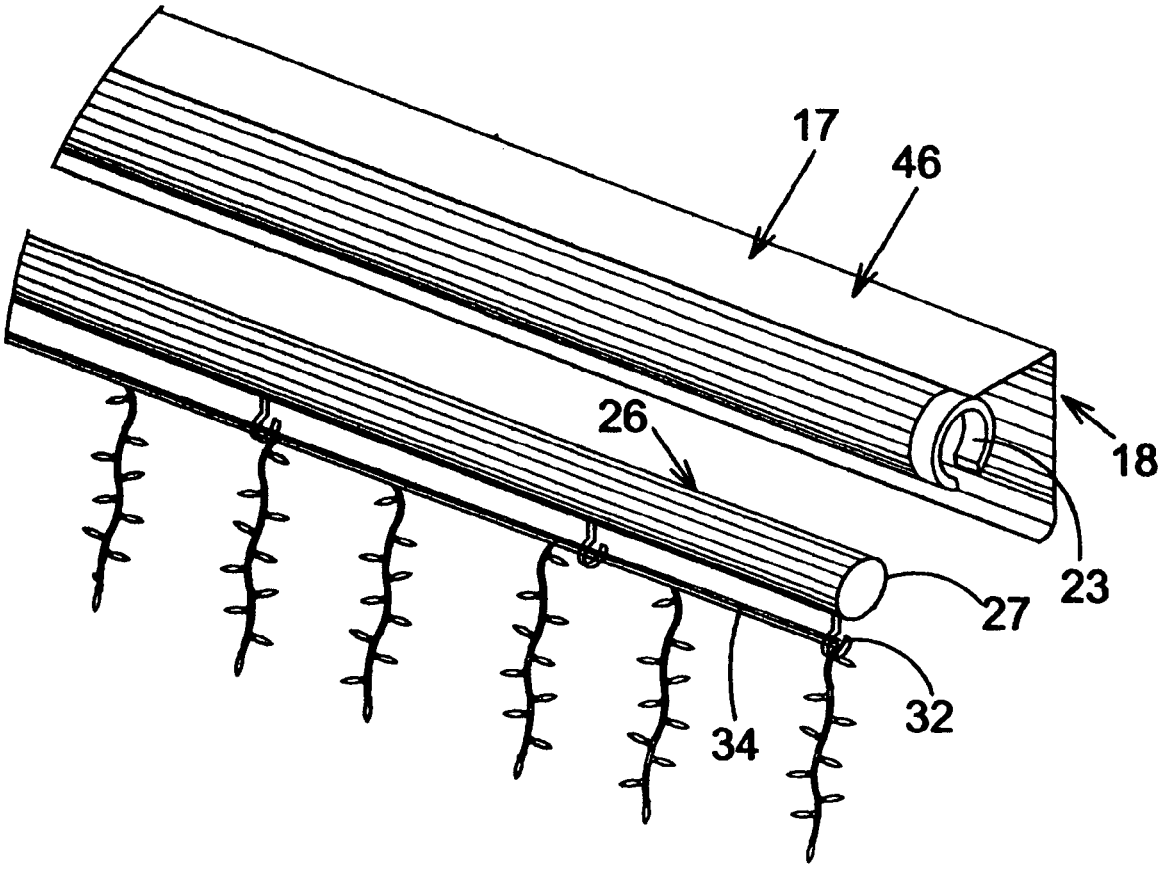
FIG. 13 is a perspective view of the roof or drip edge mounting of the present invention.

FIG. 13 is a perspective view of the roof or drip edge mounting of the present invention. Shown is the roof or drip edging (17) forming the permanent member (18) incorporating a channel (23) and mounting means (46). The roof or drip edging (17) provides means for attaching the permanent member (18) to a structure. The permanent member (18) serves as base for the dismountable member (26) that is shown as a rod (27) as the channel-engaging element while the permanent member (18) incorporates the channel element (23). The present invention provides for mating channel and channel-engaging elements with either forming an integral part of the permanent member (18) and the other forming an integral part of the dismountable member (26). The dismountable rod element (27) can slide into the permanent member (18) channel element (23). The dismountable member (26) can be of varying lengths and can incorporate elements that would allow for the folding of the dismountable member (26) into predetermined lengths suitable for storage with or without the decorative lights attached thereto.

Figure 14:
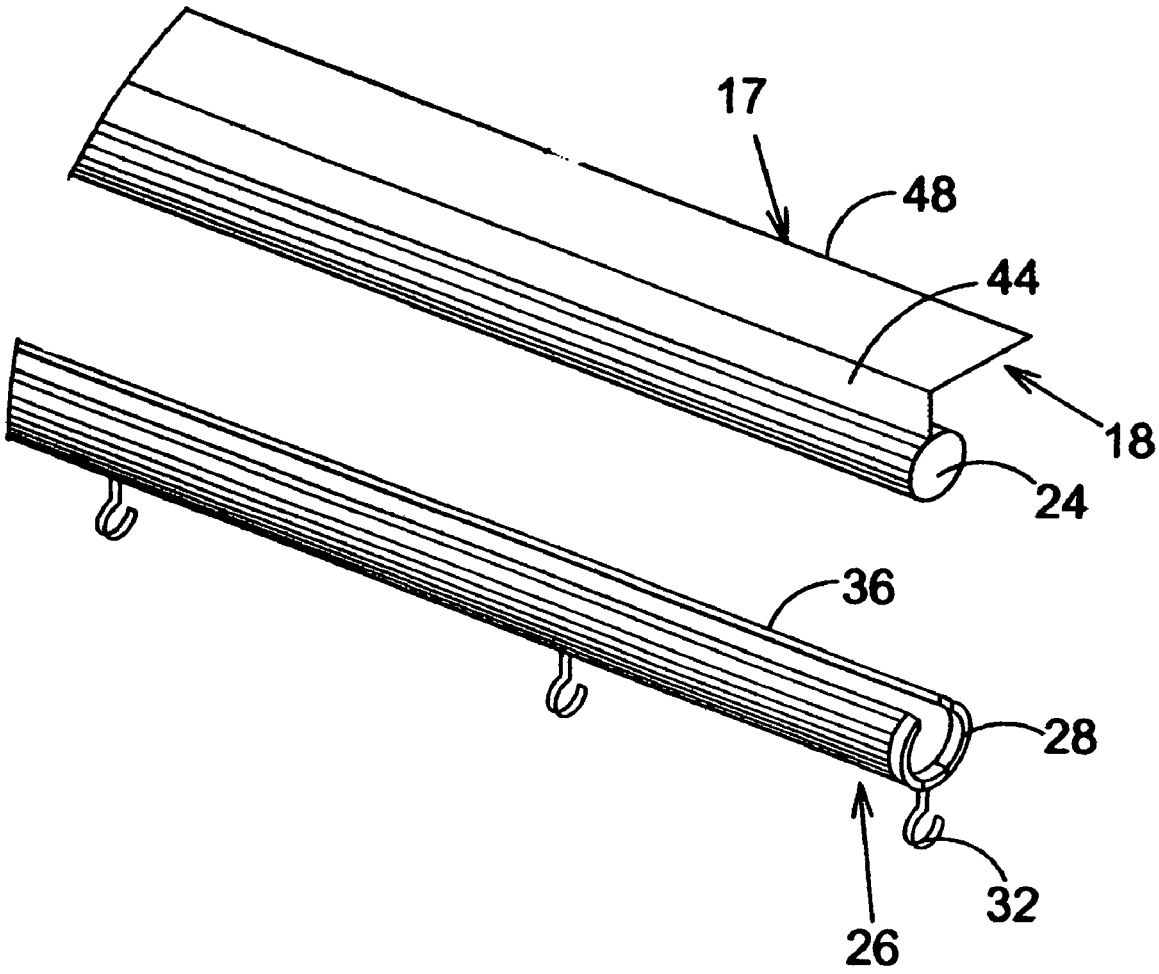
FIG. 14 is a perspective view of the roof or drip edge mounting of the present invention.

FIG. 14 is a perspective view of the roof or drip edge mounting of the present invention. Shown is the roof or drip edging (17) being the permanent member (18) having a rod (24) as the channel-engaging element spaced away (44) from the mounting means (48) that is fixed to the roof by fastening means. Once mounted the roof or drip edging (17) forms a permanent attachment serving as host to the dismountable member (26) which, in this case comprises a channel (28) because the permanent member (18) incorporates a rod (24) as the channel-engaging element. The present invention provides for mating channel and channel-engaging elements having one of them forming an integral part of the permanent member (18) while the other forms a part of the dismountable member (26). The dismountable member (26) can slide or snap onto the permanent member (18) and can be of varying lengths that can incorporate elements that would allow for the folding of the dismountable member (26) into predetermined lengths suitable for storage with or without the decorations attached thereto.

Figure 15:
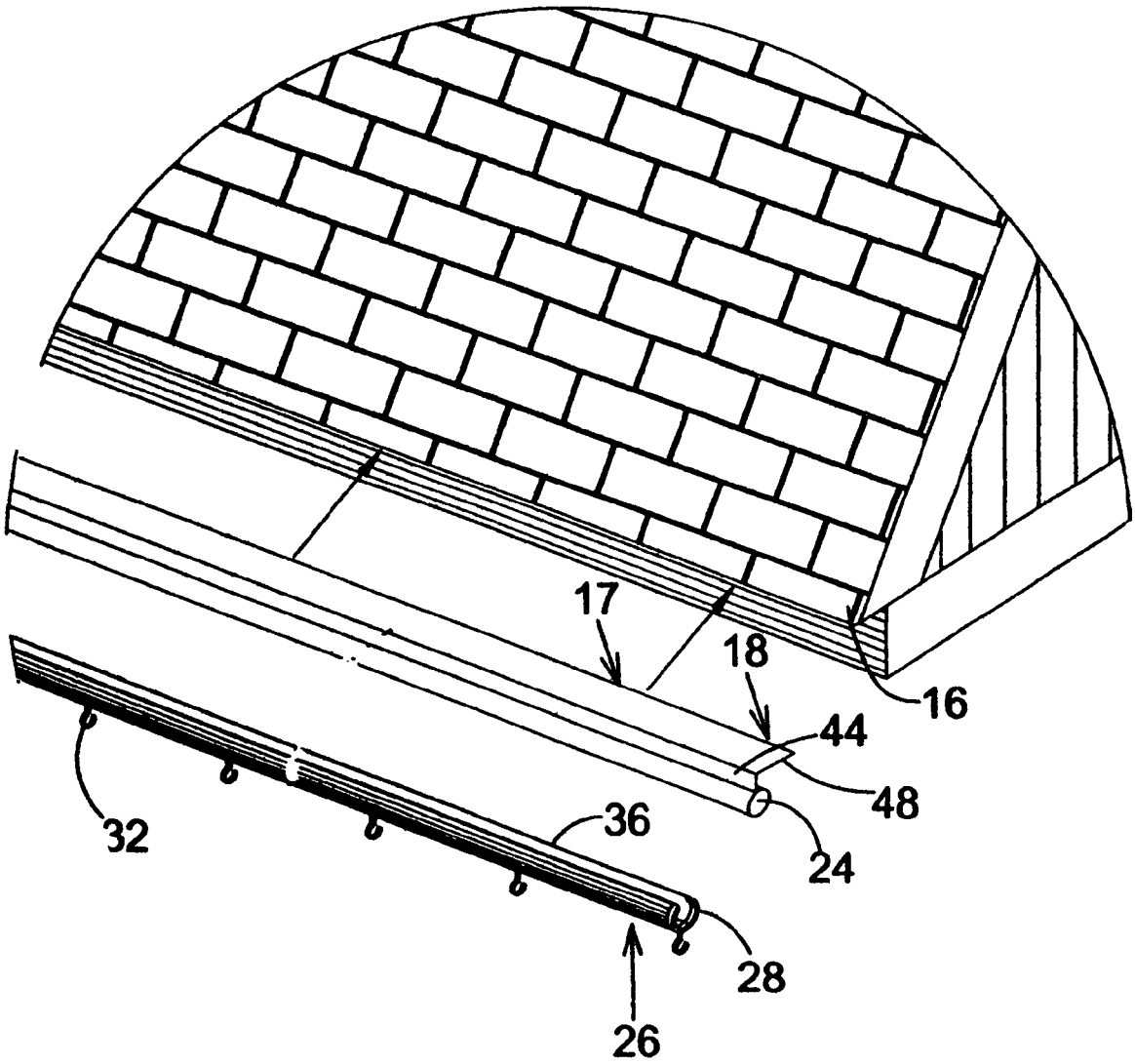
FIG. 15 is a perspective view of the roof or drip edge mounting of the present invention.

FIG. 15 is a perspective view of the roof or drip edge mounting of the present invention. Shown is the permanent member (18) comprising a roof or drip edging (17) fastenable to a roof using fasteners whereby the dismountable member (26) can be attached thereto. The dismountable member (26) can slide (28) or snap (36) onto the rod (24) of the permanent member (18). The dismountable member (26) can be of varying lengths and can incorporate elements that would allow for the folding of the dismountable member (26) into predetermined lengths suitable for storage with or without the decorations attached thereto. The present invention provides for mating channel and channel-engaging elements within permanent and dismountable member (26). The permanent member (18) has either a channel or channel-engaging element while the dismountable member (26) has the other. Shown is the permanent member (18) having a rod as the channel-engaging element while the channel forms an integral part of the dismountable member (26).

Figure 16:
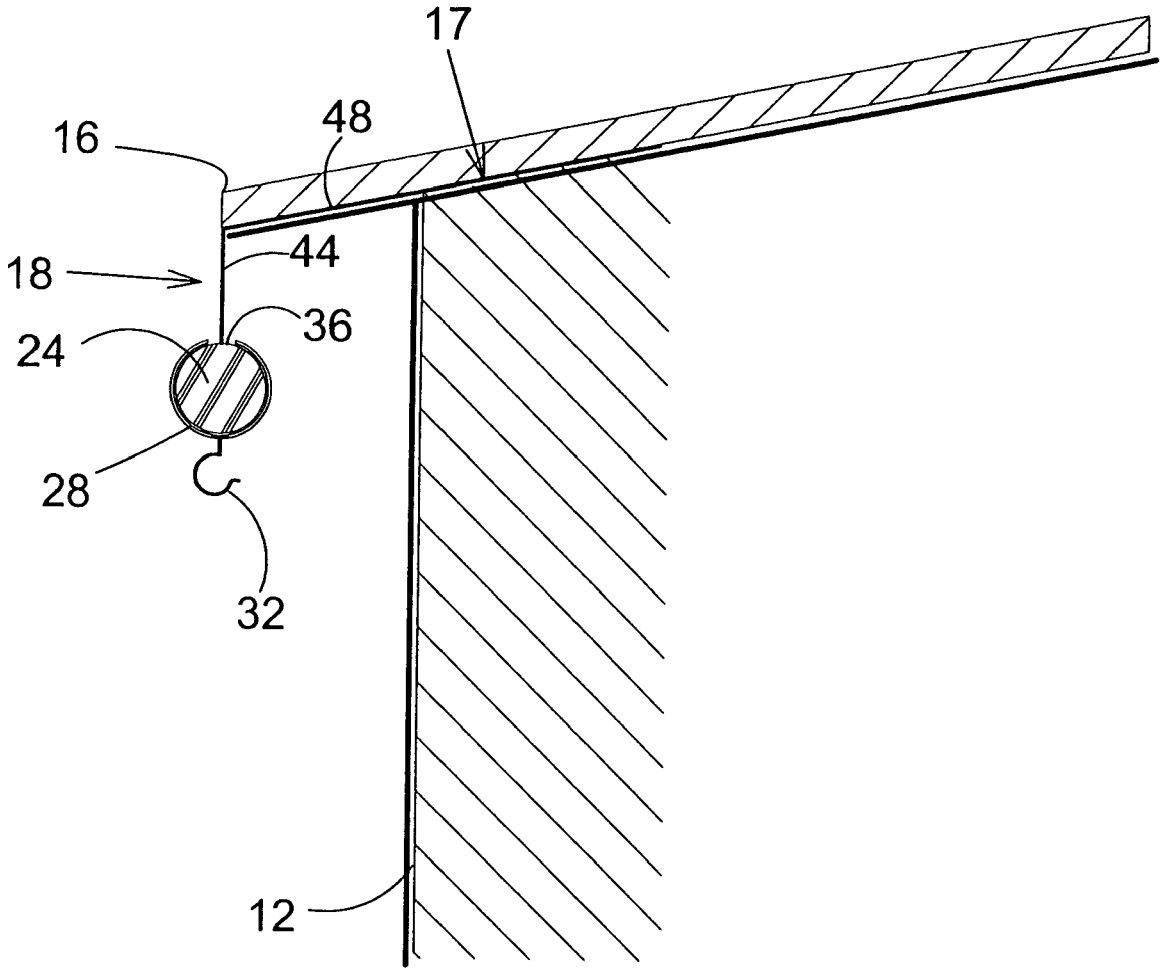
FIG. 16 is a sectional view of the roof or drip edge mounting fastened over an existing roof or drip edging.

FIG. 16 is a sectional view of the roof or drip edge mounting fastened over an existing roof or drip edging. Shown is the roof or drip edging (17) of the present invention fastened over an existing roof or drip edging of the structure (12). The present invention roof or drip edging (17) provides a simple method for displaying seasonal decorations without the fuse of having to attach fastening element such as clips year after year. The roof or drip edging (17) provides an easy method for attaching a plurality of hangers (32) to a structure by permanently mounting the roof or drip edging and thereafter simply installing and deinstalling the dismountable member (26). The dismountable member (26) can be easily fastened by sliding (28) or snapping (32) onto the rod (24) of the permanent member (18). The dismountable member (26) can also be of varying lengths to accommodate storage limitations and can incorporate elements that would allow for the folding of the dismountable member (26) into predetermined compact lengths suitable for storage. Incorporating the folding of the dismountable member (26) would provide for easy storage of the dismountable member (26) and alleviate the time consuming task of untangling lights and wires and similar decorations by leaving the decorations mounted to the dismountable member (26) during storage.

Figure 17:
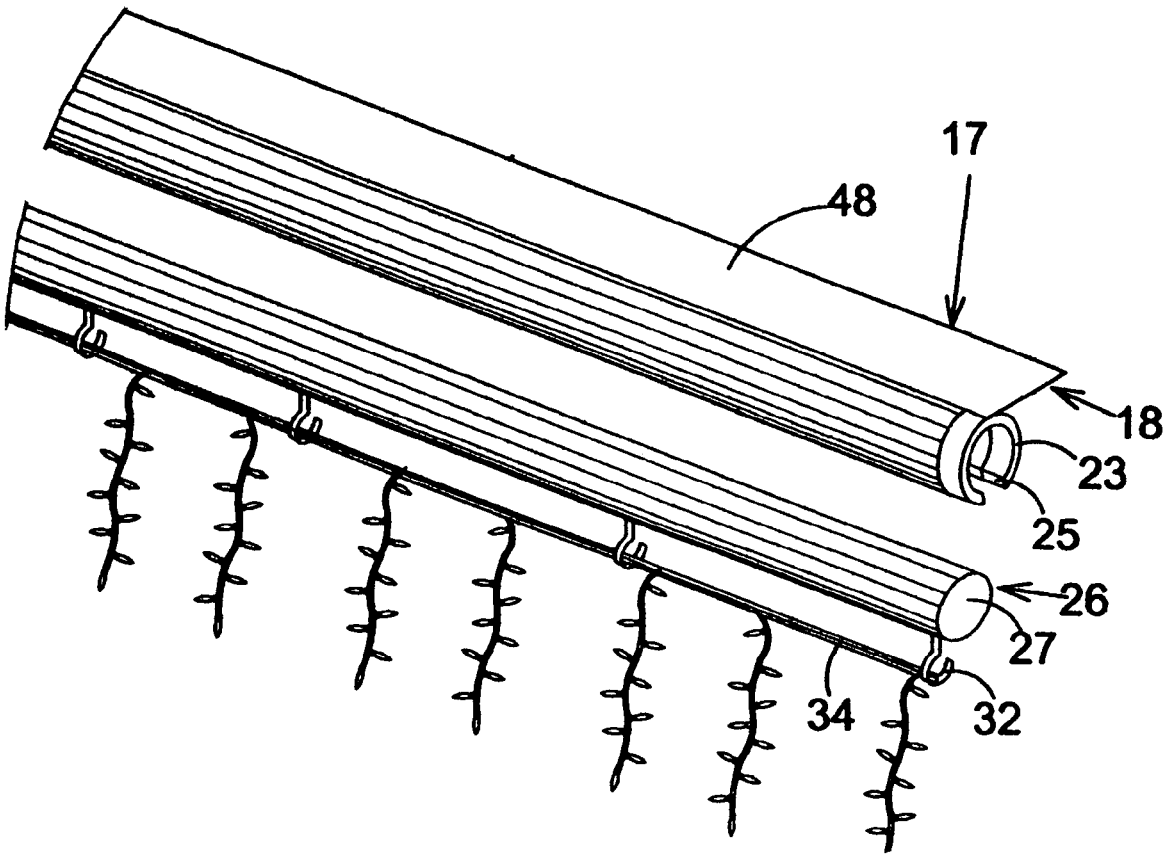
FIG. 17 is a perspective view of the roof or drip edge mounting of the present invention.

FIG. 17 is a perspective view of the roof or drip edge mounting of the present invention. Shown is the permanent roof or drip edging (17) incorporating a channel (23) with the mounting means (48) which is insertable under the roof shingles and fastened thereto. Once mounted the roof or drip edging (17) forms a permanent attachment serving as host to the dismountable member (26) which, in this case comprises a rod (27) forming the channel-engaging element because the permanent member (18) incorporates the channel element (23). The present invention provides for mating a permanent member (18) having either a channel element or channel-engaging element forming an integral part therewith while the dismountable member (26) has the mating element that forms an integral part with the dismountable element. The dismountable member (26) incorporates means for fastening (32) decorative lights (34) thereto. The dismountable member (26) can incorporate means for folding as well as being manufactured in varying lengths which would enable the dismountable member (26) to be stored in smaller spaces and with or without the decorative lights attached thereto.

Figure 18:
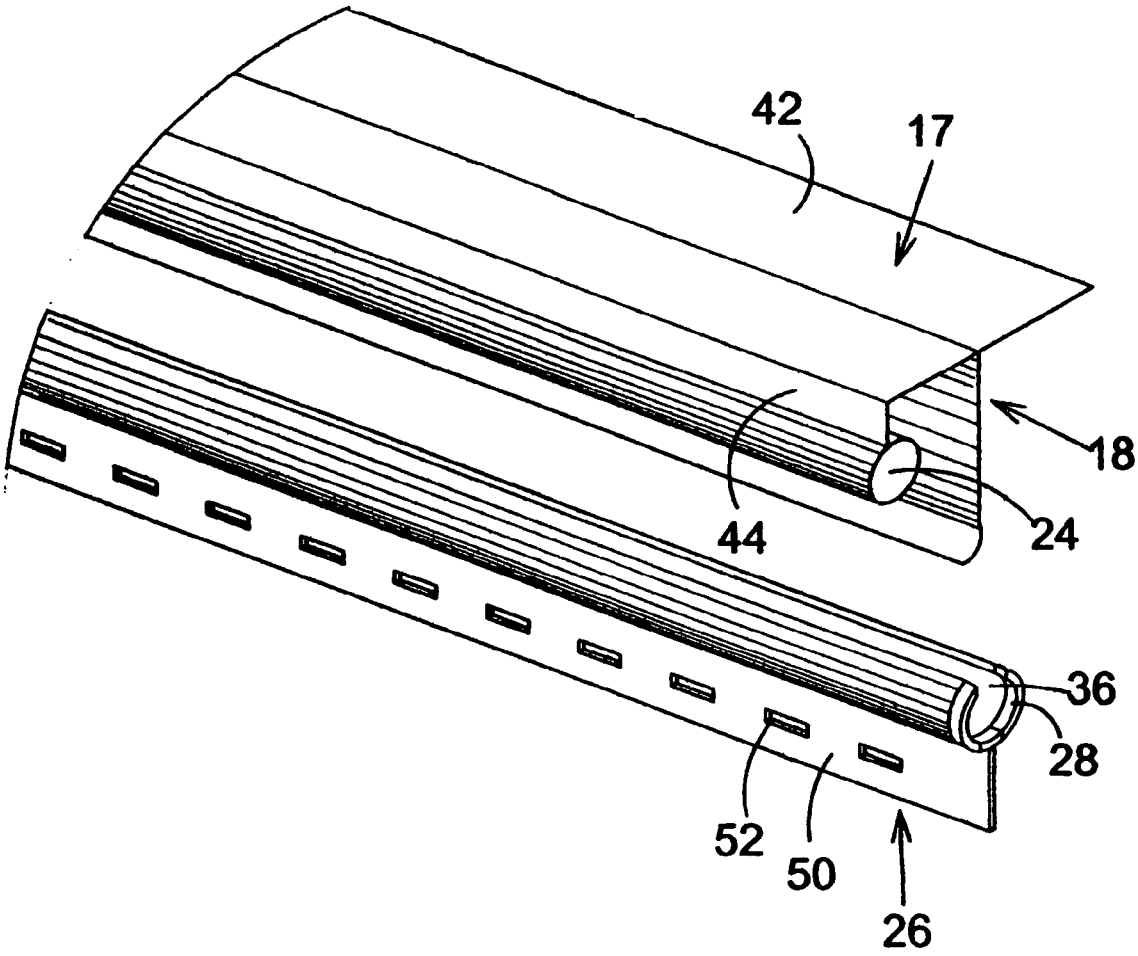
FIG. 18 is a perspective view of an alternate channel having a plurality of apertures.

FIG. 18 is a perspective view of an alternate channel having a plurality of apertures. Shown is the dismountable member (26) of the present invention having track (50) with a plurality of apertures (52) for the placements therein of lights such as icicle lights. The dismountable member (26) can slide (28) or snap (36) onto the rod (24) extending (44) from the roof or drip edging (19). The present invention provides for mating channel and channel-engaging elements regardless of which one forms a part of the permanent member (18) the opposing one would form a part of the dismountable member (26). The dismountable member (26) can also be of varying lengths and can incorporate elements that would allow for the folding of the dismountable member (26) into predetermined lengths suitable for storage with or without the decorative lights attached thereto.

Figure 19:
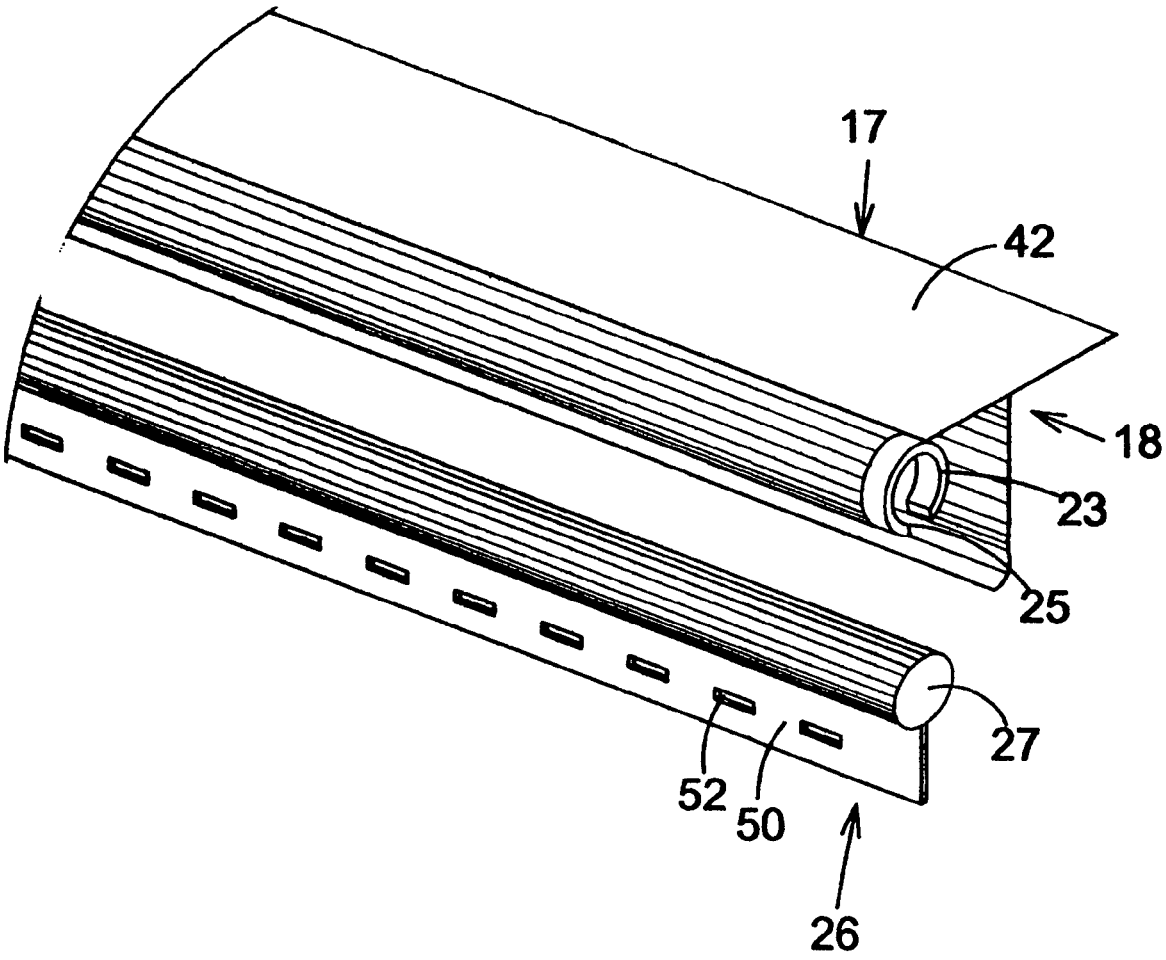
FIG. 19 is a perspective view of an alternate channel-engaging member comprising a rod having a plurality of apertures.

FIG. 19 is a perspective view of an alternate channel-engaging member comprising a rod having a plurality of apertures. Shown is the dismountable member (26) having rod (27) and track (50) with a plurality of apertures (52) for the placements therein of lights such as icicle lights. The rod (27) can be slid into the permanent member (18) having channel (23) forming an integral part of the roof or drip edging (17). The present invention provides for mating channel and channel-engaging elements wherein one or the other forms a part of the permanent member (18) while the other forms a part of the dismountable member (26). The dismountable member (26) can also be of varying lengths and can incorporate elements that would allow for the folding of the dismountable member (26) into predetermined lengths suitable for storage with or without the decorative lights attached thereto.

Figure 20:
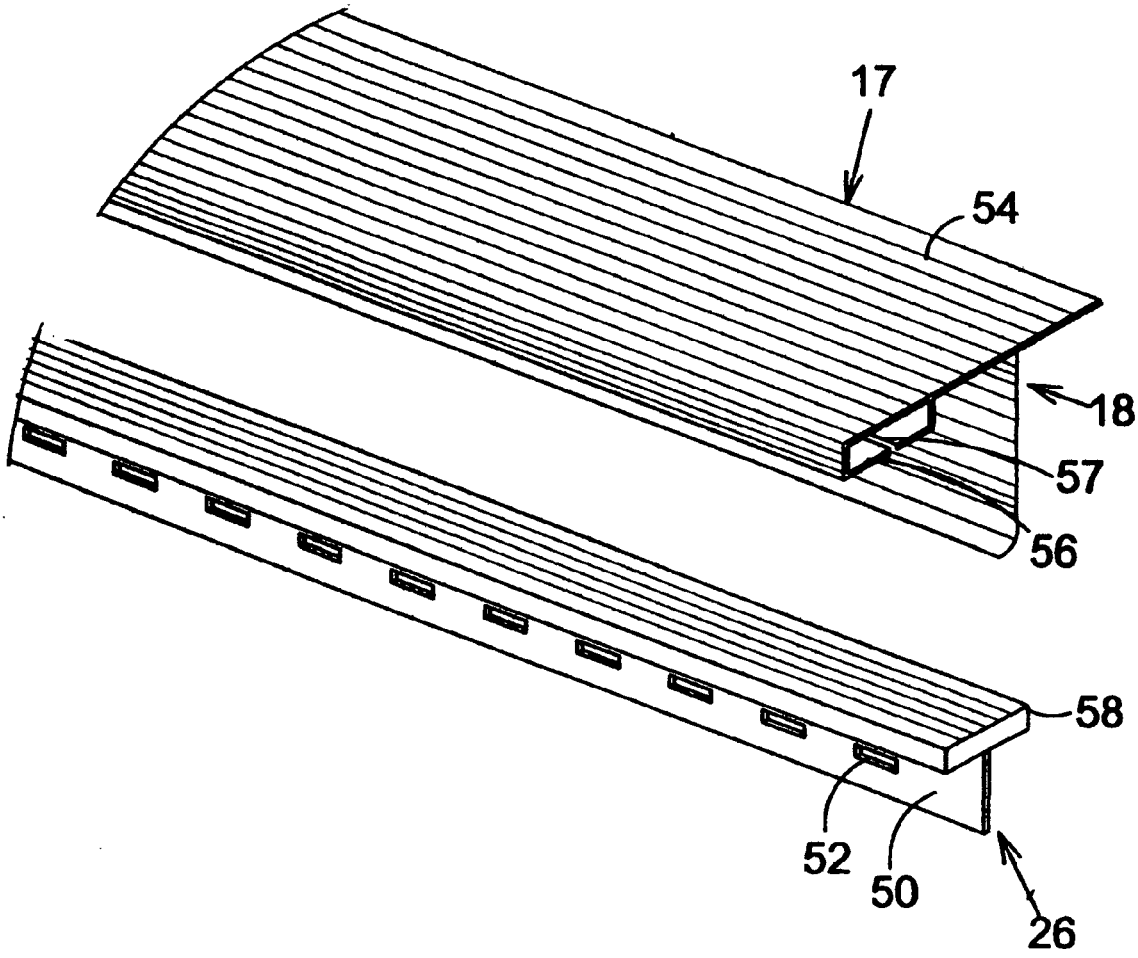
FIG. 20 is a perspective view of an alternate bar forming the channel-engaging element having a plurality of apertures.

FIG. 20 is a perspective view of an alternate bar forming the channel-engaging element having a plurality of apertures. Shown is the permanent member (18) comprised of roof or drip edging (17) having connector (54) providing means for attaching to a structure (12). The roof or drip edging (17) has track (56) with aperture (57) for the insertion therein of the dismountable member (26). The dismountable member (26) is comprised of a bar (56) with track (50) extending therefrom. The dismountable member track (50) has a plurality of apertures (52) for the placements therein of lights such as icicle lights. The bar element (58) can be slid into the roof or drip edging (17) having a slotted channel (57) extending from the roof or drip edging (17). The present invention provides for mating channel and channel-engaging elements positioned on the permanent member (18) and dismountable member (26). The permanent member (18) and dismountable member (26) have engaging components wherein one has a channel while the other has a channel-engaging member whereby they can be selectively engaged and disengaged. The dismountable member (26) has decorative lights attached thereto. The lights can be left on the dismountable member (26) and stored thereon.

Figure 21:
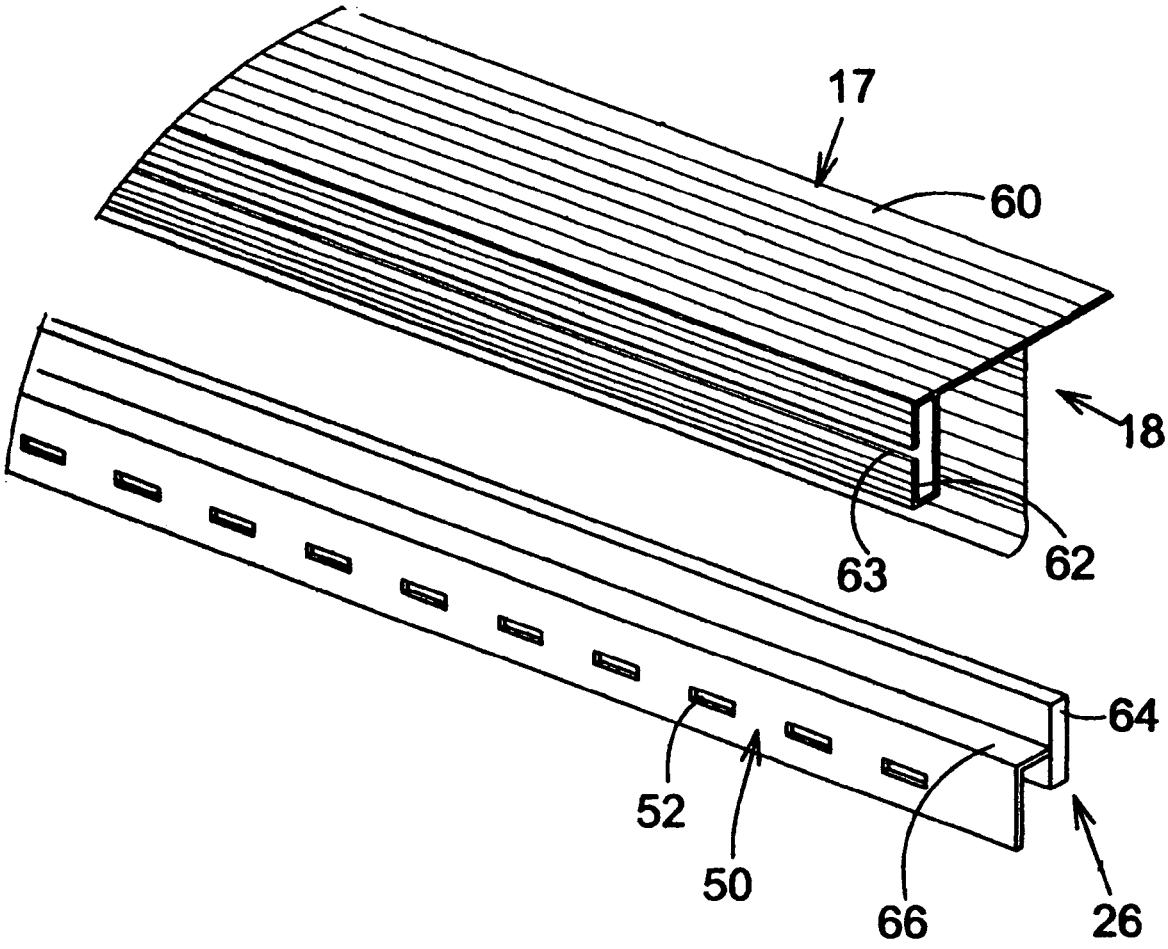
FIG. 21 is a perspective view of an alternate bar channel-engaging element.

FIG. 21 is a perspective view of an alternate bar channel-engaging element. Shown is an alternate dismountable member (26) comprising a bar channel-engaging element (64) spaced away (66) from track (50) having a plurality of aperture (52) for the placements therein of lights such as icicle lights. The bar element (64) can be slid into the permanent (18) roof or drip edging (17) having a slotted channel (62) with aperture (63). The present invention provides for mating channel and channel-engaging elements wherein either the channel or channel-engaging element forms an integral part of the permanent member (18) while the other forms an integral part of the dismountable member (26). The dismountable member (26) can be of varying lengths and incorporate elements that would allow for the folding of the dismountable member (26) into predetermined lengths suitable for storage with or without the decorative lights attached thereto.

Figure 22:
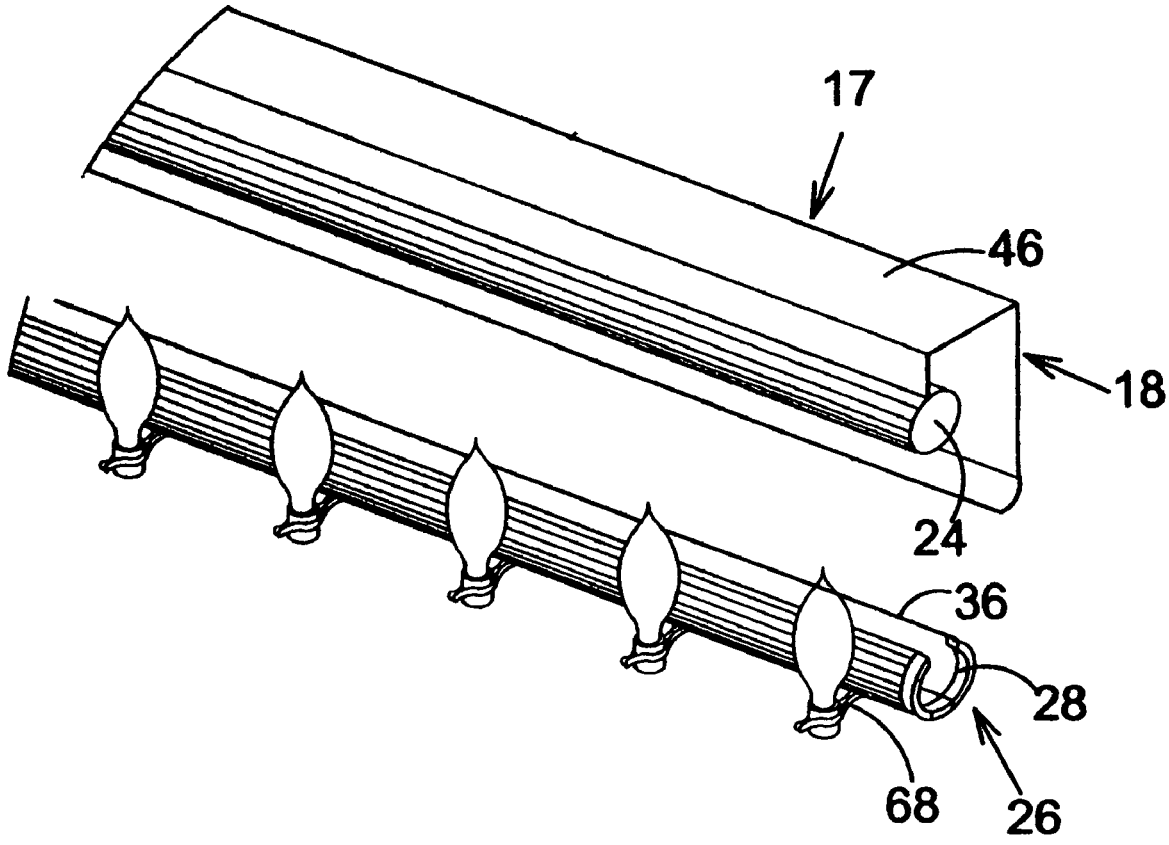
FIG. 22 is a perspective view of the roof or drip edge mounting of the present invention.

FIG. 22 is a perspective view of the roof or drip edge mounting of the present invention. Shown is the roof or drip edge (17) having a rod (24) spaced away (44) from the mounting means which is used to fixedly position the permanent member (18) to the structure (12). Once mounted the roof or drip edging (17) forms the permanent (18) attachment serving as host to the dismountable member (26) which, in this case would comprise a channel element (28) because the permanent member (18) incorporates a rod (24) as the channel-engaging element. Also shown is the dismountable member (26) having clip fasteners (68) whereby light strings having large bulb sockets can be mounted therein. The present invention provides for mating channel and channel-engaging elements of the permanent member (18) and dismountable member (26). Wherein one has the channel while the other has the channel-engaging element. The dismountable member (26) can slide or snap onto the permanent member (18). The dismountable member (26) can also be of varying lengths and incorporate elements that would allow for the folding of the dismountable member (26) into predetermined lengths suitable for storage with or without the decorations attached thereto.

What is claimed is:

1. Gutter mounting apparatus comprising:

a) a gutter mounted on an exterior surface of a building having at least one support member extending from an upper end of an outer wall of said gutter to said exterior surface for supporting said gutter on said exterior surface of said building;

b) a member permanently attached to said gutter to support a dismountable member for supporting seasonal decorations;

c) said permanently attached member comprising a horizontal flat section extending along a top edge of the outer wall of said gutter, a first downwardly extending wall from a distal edge of said flat section outside of said gutter spaced from the outer wall of said gutter, a horizontally extending rod suspended from and mounted along a bottom edge of said first downwardly extending wall, a second downwardly extending wall extending downwardly from a proximate edge of said flat section within said gutter, and a flange attached to a bottom edge of said second downwardly extending wall;

d) said flange having a recess and said support member of said gutter having a recess, the recess of the flange being aligned with the recess of the support member of the gutter to accommodate a fastener for attaching said flange to said support member; and e) a dismountable member for sliding on or snapping onto said rod, said dismountable member having supports for said seasonal decorations.

2. Gutter mounting apparatus comprising:

a) a gutter mounted on an exterior surface of a building having a support for attaching said gutter to said exterior surface of said building;

b) a permanent member mounted on said gutter adapted to support a dismountable member for supporting seasonal decorations, said permanent member including a solid rod suspended on the outside of and spaced from said gutter;

c) said dismountable member adapted to slide or snap onto said rod; and d) hooks spaced on an external surface of said dismountable member for suspending said seasonal decorations, wherein said permanent member comprises:

i) a U-shaped connector comprising digital edge spaced from an outer wall of said gutter, a first downwardly extending wall extending downwardly from said distal edge attached to and supporting said rod, a top wall extending from said distal edge over a top edge of said outer wall of said gutter, and second downwardly extending wall adjacent to an inner surface of said outer wall of said gutter;

ii) a flange extending from said second downwardly extending wall within aid glitter, said flange having at least one recess;

iii) said rod extending along a length of said U-shaped connector; and iv) a fastener extending through said recess and said glitter support for securing said permanent member to the gutter.

3. The apparatus as recited in claim 2, wherein said dismountable member is a tube having a channel extending along the length thereof, said channel having a shape and diameter corresponding to a shape and diameter of said rod, and said hooks are positioned along a circumference of said tube, wherein, upon aligning said tube with said U-shaped connector of said permanent member, said rod is received within said channel thereby mounting the seasonal decorations to the structure.

* * * * *